US005743720A

United States Patent [19]

Sano et al.

[11] Patent Number: 5,743,720

[45] Date of Patent: Apr. 28, 1998

[54] SCROLL COMPRESSOR WITH AXIAL BIASING

[75] Inventors: Fumiaki Sano; Masayuki Kakuda; Hiroshi Ogawa; Kiyoharu Ikeda; Yoshihide Ogawa; Eiji Watanabe; Toshiyuki Nakamura; Shuji Motegi, all of Kanagawa; Norihide Kobayashi, Wakayama, all of Japan

[73] Assignee: Mitsubishi Denki Kabushiki Kaisha, Tokyo, Japan

[21] Appl. No.: 505,384

[22] Filed: Jul. 21, 1995

[30] Foreign Application Priority Data

| | | | |
|---|---|---|---|
| Jul. 22, 1994 | [JP] | Japan | 6-171125 |
| Mar. 20, 1995 | [JP] | Japan | 7-060291 |
| Mar. 27, 1995 | [JP] | Japan | 7-068119 |
| Jul. 4, 1995 | [JP] | Japan | 7-168414 |

[51] Int. Cl.[6] ..... F01C 1/04

[52] U.S. Cl. ..... 418/55.5; 418/55.2

[58] Field of Search ..... 418/55.2, 55.5

[56] References Cited

U.S. PATENT DOCUMENTS

| | | | |
|---|---|---|---|
| 3,874,827 | 4/1975 | Young . | |
| 4,061,447 | 12/1977 | Kato . | |
| 4,243,233 | 1/1981 | Arai . | |
| 4,314,796 | 2/1982 | Terauchi . | |
| 4,406,600 | 9/1983 | Terauchi et al. . | |
| 4,460,321 | 7/1984 | Terauchi . | |
| 4,548,555 | 10/1985 | Hiraga et al. | 418/55.2 |
| 4,714,415 | 12/1987 | Mizuno et al. . | |
| 4,753,582 | 6/1988 | Morishita et al. . | |
| 4,767,293 | 8/1988 | Caillat et al. . | |
| 4,877,382 | 10/1989 | Caillat et al. . | |
| 4,890,987 | 1/1990 | Sato et al. . | |
| 5,071,323 | 12/1991 | Sakashita et al. . | |
| 5,088,906 | 2/1992 | Richardson, Jr. | 418/55.5 |
| 5,141,421 | 8/1992 | Bush et al. . | |

(List continued on next page.)

FOREIGN PATENT DOCUMENTS

| | | |
|---|---|---|
| 0 037 658 | 10/1981 | European Pat. Off. . |
| 0 043 701 | 1/1982 | European Pat. Off. . |
| 0 061 065 | 9/1982 | European Pat. Off. . |
| 0 122 722 | 10/1984 | European Pat. Off. . |
| 0 144 169 | 6/1985 | European Pat. Off. . |
| 0 174 092 | 3/1986 | European Pat. Off. . |
| 0 464 282 | 1/1992 | European Pat. Off. . |
| 0 492 759 | 7/1992 | European Pat. Off. . |
| 0 584 036 | 2/1994 | European Pat. Off. . |
| 0 608 073 | 7/1994 | European Pat. Off. . |
| 62-199986 | 9/1987 | Japan . |
| 63-80088 | 4/1988 | Japan . |
| 4-231691 | 8/1992 | Japan . |
| 4-103203 | 9/1992 | Japan . |
| 4-255586 | 9/1992 | Japan . |
| 5-26180 | 2/1993 | Japan . |
| 5-149269 | 6/1993 | Japan . |
| 5-263776 | 10/1993 | Japan . |
| 2 162 899 | 2/1986 | United Kingdom . |
| 2 194 291 | 3/1988 | United Kingdom . |
| WO 82/03429 | 10/1982 | WIPO . |
| WO 93/20332 | 10/1993 | WIPO . |

*Primary Examiner*—Charles G. Freay

*Attorney, Agent, or Firm*—Oblon, Spivak, McClelland, Maier & Neustadt, P.C.

[57] ABSTRACT

The invention concerns a high-reliability scroll compressor with little moment for making a fixed scroll unstable. A scroll compressor comprising in a sealed vessel a fixed scroll, an orbiting scroll being combined with the fixed scroll for forming a compression space, and executing orbiting motion with respect to the fixed scroll, a frame for axially supporting the orbiting scroll and radially supporting a drive shaft, and a seal member being disposed in an axial gap between a high and low pressure separator stuck to the frame by any method and the fixed scroll. A base plate outer peripheral surface of the fixed scroll is radially supported by a stationary member coaxial with the base plate outer peripheral surface, and with the stationary member as a guide. The fixed scroll can make axial movement within a range in which it interferes with the orbiting scroll downward in the axial direction and with the high and low pressure separator upward in the axial direction.

12 Claims, 14 Drawing Sheets

U.S. PATENT DOCUMENTS 5,188,520 2/1993 Nakamura et al. .
5,197,868 3/1993 Caillat et al. .
5,222,881 6/1993 Sano et al. .
5,295,813 3/1994 Caillat et al. .
5,328,342 7/1994 Ishii et al. .
5,358,391 10/1994 Wallis et al. .
5,366,359 11/1994 Bookbinder et al. .
5,435,707 7/1995 Hirano et al. ..... 418/55.5
5,458,471 10/1995 Ni ..... 418/55.5
5,511,959 4/1996 Tojo et al. ..... 418/55.5

SCROLL COMPRESSOR WITH AXIAL BIASING

BACKGROUND OF THE INVENTION

This invention relates to a scroll compressor used in an air conditioner, a refrigerator, etc.

FIG. 20 is a longitudinal sectional view of a scroll compressor disclosed in Japanese Patent Laid-Open No.Sho 62-199986 (conventional example 1).

In FIG. 20, numeral 1 is a fixed scroll having one lower side formed with a plate-like spiral tooth 1*a*, and a bed plate 1*b* has an outer periphery in the form of a cylindrical surface. A protrusion in the form of a hollow circular column is formed on the opposite face to the plate-like spiral tooth 1*a* (upper side of the fixed scroll 1) and a groove for housing a seal member 10 separating high pressure and low pressure is formed on the outer face of the protrusion.

Numeral 2 is an orbiting scroll having one upper side formed with a plate-like spiral tooth 2*a*, and a boss part 2*b* receiving a drive force from a spindle 8 is projected on the opposite side (lower side).

Numeral 3 is a frame having an outer peripheral surface stuck to a sealed vessel 9 and an upper end face fixed to a high and low pressure separator 4. The frame 3 supports a thrust load of the orbiting scroll 2 and supports the spindle 8 radially.

The fixed scroll 1 is restrained in radial and rotation directions by a pin 5 pressed into the high and low pressure separator 4.

Numeral 7 is an Oldham's coupling for restraining rotation of the orbiting scroll 2 and determining a phase between the orbiting scroll 2 and the frame 3.

Numeral 8 is a spindle and torque for driving the orbiting scroll 2 is given from a motor thereto.

Numeral 4*e* is an oil return hole made in the high and low pressure separator 4, and an oil return hole 3*f* is also made in the frame 3 at a position corresponding to the oil return hole 4*e*.

Next, the operation of the scroll compressor in the conventional example 1 will be discussed. First, an axial force that acts on the fixed scroll 1 will be described. An upward pushing force caused by gas pressure in the compression space acts on the fixed compressor 1. On the other hand, high pressure acts on the center of the seal member 10 on the rear of the fixed scroll 1 to cause a force which presses the fixed scroll 1 to slide along the pin 5 pressure-inserted into the high and low pressure separator as a guide downward against the orbiting scroll 2.

Next, a radial force that acts on the fixed scroll 1 will be described. A radial force mainly caused by gas pressure in the compression space acts on the plate-like spiral tooth 1*a* of the fixed scroll 1. The force is transmitted via a boss part 1*g*, projecting from the base plate 1*b* of the fixed scroll 1, to the high and low pressure separator 4.

Next, a moment in the rotation direction that acts on the fixed scroll 1 will be described. A moment in the rotation direction mainly caused by gas pressure in the compression space acts on the fixed scroll 1 like the orbiting scroll 2. At the orbiting scroll 2, the moment is received by the Oldham's coupling 7; at the fixed scroll 1, it is received by means of the pin 5.

A scroll compressor having a similar structure is disclosed in Japanese Patent Laid-Open No.Hei 5-263776 (conventional example 2), in which the outer periphery of the base plate 1*b* of the fixed scroll 1 and the abutment surface of the frame 3, that receives the outer periphery of the base plate 1*b* movably in the axial, upward direction, are both enlarged in diameter in the direction opposite from the compression space to form tapered surfaces, and a minute clearance is formed between the tip and bottom of the plate-like spiral teeth. In the conventional example 2, a plurality of pins 5 are projected on the frame 3 to restrict the movement of the fixed scroll 1 in the circumferential direction.

FIG. 21 is a longitudinal sectional view of a scroll compressor disclosed in Japanese Patent Laid-Open No.Sho 63-80088 (conventional example 3).

The structure and operation of conventional example 3 will be discussed with referenced to FIG. 21. Parts identical with or similar to those previously described with reference to FIG. 20 are denoted by the same reference numerals in FIG. 21 and will not be discussed again. Numeral 1 is a fixed scroll and four screw holes for bolts are provided around the outer periphery of a base plate 1*b*. Numeral 12 is a plate spring formed with four drill holes for bolts. Bolts are inserted into the two drill holes at both ends of the plate spring 12 for fixing the plate spring 12 to the upper end face of the elongated portion of the base plate 1*b* of the fixed scroll 1. Also, bolts 15 are inserted into the two drill holes at the center of the plate spring 12 for fixing the plate spring 12 to the upper end face of a frame 3. Thus, the fixed scroll 1 and the frame 3 are elastically coupled axially by the plate spring 12, but basically fixedly coupled in radial direction and rotation direction around the axis.

Means for restraining an axial upward movement of the fixed scroll 1 is a member stuck to the frame 3 by the bolts 15. A high and low pressure separator 4 is not positioned with respect to the frame 3 and is welded all around to a sealed vessel 9.

FIG. 22 is a longitudinal sectional view of a scroll compressor disclosed in Japanese Patent Laid-Open No.Hei 4-231691 (conventional example 4).

In FIG. 22, numeral 1 is a fixed scroll 1 having a planar portion 1*q* on the surface opposite from the spiral tooth of a base plate 1*b*. Numeral 4 is a high and low pressure separator having a planar portion 4*c* parallel with the planar portion 1*q* of the fixed scroll 1. Numeral 10 is a seal member for sealing high and low pressure, which is located between the planar portions.

The high and low pressure separator 4 is welded all around to a sealed vessel 9 at a junction 4*d*.

FIG. 23 is a longitudinal sectional view of the main part showing a conventional scroll compressor, for example, disclosed in Japanese Patent Laid-Open No.Hei 5-149269, wherein numeral 9 is a sealed vessel, and numeral 1 is a fixed scroll that has a base plate 1*b* placed near to one end face 9*a* in the sealed vessel 9, a fixed scroll plate-like spiral tooth 1*a* formed on the side of the base plate 4 opposite from the end face 9*a*, a circular cylinder 35 provided at the center of the base plate 1*b* and placed on the side of the end face 9*a*, a protrusion edge 36 protruding from the outer peripheral surface of the base plate 1*b* toward the end face 9*a*, and a discharge port 1*e* arranged at the center of the base plate 1*b*.

Numeral 2 is an orbiting scroll having an orbiting scroll plate-like spiral tooth 2*a* disposed on a base plate 2*c* facing the fixed scroll plate-like spiral tooth 1*a* to engage the fixed scroll plate-like spiral tooth 1*a* for forming a compression space 21, and a boss 23 formed on the side of the base plate 2*c* opposite from the orbiting scroll plate-like spiral tooth 2*a*.

Numeral 3 is a frame which has an outer peripheral surface fixed in the sealed vessel 9 and is placed on the side of the orbiting scroll 2 opposite from the fixed scroll 1 and provided with a bolt 37 inserted in the fixed scroll 1 and screwed into the upper end for displacably holding the fixed scroll 1 in the central axial direction of the sealed vessel 9 and prohibiting displacement of the fixed scroll 1 toward the end face 9*a* at a predetermined position and diametric and pivotal displacement of the fixed scroll 1 with respect to the sealed vessel 9.

Numeral 4 is a high and low pressure separator fixed between the fixed scroll 1 and the end face 9*a* of the sealed vessel 9 and provided with a fit circular cylinder 38 fitted in the circular cylinder 6 at the opposite face to the fixed scroll 1, a fit protrusion 39 fitted in the protrusion edge 36 at the opposite face to the fixed scroll 1, and a discharge port 4*f* placed at the center.

Numeral 10 is a seal member provided between the circular cylinder 35 and the fit circular cylinder 38. Numeral 11 is a seal member provided between the protrusion edge 36 and the fit protrusion 39.

Numeral 22 is a high pressure chamber formed in the discharge port 4*f* of the high and low pressure separator 4, numeral 4*a* is a back pressure chamber defined by the circular cylinder 35, the protrusion edge 36, the fit circular cylinder 38, and the fit protrusion 39, and numeral 24 is a low pressure chamber defined by the protrusion edge 36, the fit protrusion 39, and the side face of the sealed vessel 1 confronted thereto.

Numeral 1*d* is an extraction hole made in the base plate 1*b* of the fixed scroll 1 and communicated with the compression space 21 and the back pressure chamber 4*a*. Numeral 26 is an Oldham's coupling disposed between the base plate 2*c* of the orbiting scroll 2 and the frame 3 for restraining the rotation of the orbiting scroll 2 and positioning the orbiting scroll 2 and the frame 3.

Numeral 8 is a shaft of an electric motor (not shown) provided in the sealed vessel 9 and fitted in the boss 23 of the orbiting scroll 2 for driving the orbiting scroll 2.

The conventional scroll compressor is structured as mentioned above, and when the electric motor is energized, the shaft 8 turns and drives the orbiting scroll 2, whereby the volume of the compression space 21 defined by the fixed scroll plate-like spiral tooth 1*a* and the orbiting scroll plate-like spiral tooth 2*a* decreases from the outer periphery to inner periphery of the spiral teeth. A low-pressure refrigerant gas flows into the compression space 21 and is compressed to a high-pressure refrigerant gas, which is sent from the discharge port 1*e* of the fixed scroll 1 to the discharge port 4*f* of the high and low pressure separator 14 provided eccentrically with the discharge port 1*e*.

At this time, a press force in a direction toward the end face 9*a* of the sealed vessel 9 is caused by refrigerant gas pressure in the compression space 21 and acts on the fixed scroll 1. On the other hand, a high pressure acts on the high and low pressure separator (4) side of the fixed scroll 1 and the inside of the seal member 10, and an intermediate pressure acts on the back pressure chamber 4*a*. The refrigerant gas pressure causes the fixed scroll 1 to be pressed against the orbiting scroll 2.

FIG. 24 is a longitudinal sectional view of the main part showing another conventional scroll compressor, for example, disclosed in Japanese Patent Laid-Open No.Hei 5-26180. Parts identical with or similar to those previously described with reference to FIG. 23 are denoted by the same reference numerals in FIG. 24. Numeral 28 is a pressure release device made up of a relief port 29 and an opening/closing valve 30 disposed in a high and low pressure separator 4.

The conventional scroll compressor having the structure in FIG. 24 also operates like the scroll compressor in FIG. 23, to compress a refrigerant gas. When the pressure in a back pressure chamber 4*a* becomes higher than that in a high pressure chamber 22, the pressure release device 28, namely, the opening/closing valve 30 opens.

In the conventional scroll compressor, namely that described in Japanese Patent Laid-Open No.Sho 62-199986, since the pin 5 pressure-inserted into the base plate 1*b* of the fixed scroll 1 supports the radial load of the fixed scroll 1, area of the sliding portion is restricted thereby, and abnormal wearing of the guide part occurs due to occurrence of the incomplete contact or the like by the tilt of the fixed scroll.

In the conventional scroll compressor of the example 2 as described in Japanese Patent Laid-Open No.Hei 5-263776, the axial support member for the fixed scroll 1 is the upper end face (a tapered surface enlarged in diameter in a direction opposite from the compression chamber) of the frame 3, and a clearance is formed between the tip and bottom of the plate-like spiral teeth, and thus the fixed scroll 1 does not come in axial contact with the orbiting scroll 2; resultantly, a gap occurs between the plate-like spiral tooth tip and bottom and leakage from the gap deteriorates efficiency. Further, the fixed scroll tilts along the tapered surface, as a consequence of which a gap occurs and leakage from the gap deteriorates the efficiency.

In the conventional scroll compressor, namely that disclosed in Japanese Patent Laid-Open No.Sho 63-80088 (the conventional example 3), there are provided a seal member 10 for separating a discharge space (high pressure) and an intermediate pressure chamber 4*a* (intermediate pressure) and a seal member 11 for separating the intermediate pressure chamber 4*a* (intermediate pressure) and a suction space 24 (low pressure) on circular cylinder faces provided on the top of the fixed scroll 1. In this case, there are a plurality of circular cylinder face fitting portions in assembling the fixed scroll 1 to the high and low pressure separator 4, which make it difficult to assemble them together, and in addition thereto, since clearance imbalance between the fitting portions is caused by a machining error, the seal failure occurs at seal places.

For example, if a valve (not-shown in the drawings) for a suction pipe of the compressor is failed to open at the initial operation of the scroll compressor, there occurs so-called vacuum operation in which suction pressure (low pressure) becomes close to vacuum. In the conventional scroll compressor of the example 3 as disclosed in Japanese Patent Laid-Open No.Sho 63-80088, the fixed scroll 1 is strongly pressed against the orbiting scroll 2 at the vacuum operation due to high pressure in the discharge space, thus the tooth tip is seized. At the vacuum operation, little refrigerant gas flows, and the plate-like spiral tooth 1*a* of the fixed scroll and the plate-like spiral tooth 2*a* of the orbiting scroll become high in temperature. Further, a minute amount of lubrication oil normally supplied together with refrigerant gas is not supplied either. Under this condition, if the tooth tip of the plate-like spiral tooth is strongly pressed against the tooth bottom of the mate, the tooth tip is seized at high possibility.

In a scroll compressor, balanced compression operation can be achieved as the volumes of paired crescent-shaped compression spaces decrease in synchronization. Since the scroll compressor similar to the conventional scroll compressor of the example 3 as disclosed in Japanese Patent Laid-Open No.Sho 63-80088 is formed with only one extraction hole 1*d*, the compression space communicated with the intermediate pressure chamber 4a via the extraction hole and the other compression space becomes unbalanced because of the presence or absence of the effect of the intermediate pressure chamber 4a. Thus, an abnormal rotation moment occurs in the fixed scroll 1 and the orbiting scroll 2, causing trouble on reliability.

In the conventional scroll compressor of the example 3 as disclosed in Japanese Patent Laid-Open No.Sho 63-80088, the tooth tips of the plate-like spiral teeth always come in slide contact with the tooth bottoms at the steady operation time, thus wear of the tooth tips is developed. As a result, the stroke volume of the compressor decreases and the compressor does not provide a predetermined capability or the refrigerant circuit throttle is clogged with wear powder, causing refrigeration failure.

In the conventional scroll compressor of example 3 as disclosed in Japanese Patent Laid-Open No.Sho 63-80088, the plate spring 12 connecting the fixed scroll 1 and the frame 3 is fastened to the fixed scroll 1 and the frame 3 simply by bolts, thus shifts during the operation, particularly when receiving high pressure at the liquid compression time or the like; performance failure occurs due to out-of-phase or noise increases due to diametric shift.

In the conventional scroll compressor of the example 3 as disclosed in Japanese Patent Laid-Open No.Sho 63-80088, the plate spring 12 is fixed to the upper end face of the extension of the base plate 1b of the fixed scroll 1 by bolts. Thus, the screw holes for the bolt must be made in the base plate extension below it, and the fixed scroll 1 has a large volume more than necessary. As a result, the fixed scroll 1 is poor in follow-up operability; it is disadvantageous for performance and reliability.

The conventional scroll compressor of the example 3 as disclosed in Japanese Patent Laid-Open No.Sho 63-80088 does not contain means for positioning the fixed scroll 1 and the frame 3 (the frame 3 being phase-determined with the orbiting scroll 2 by the Oldham's coupling). Thus, the fixed scroll 1 and the orbiting scroll 2 shifts relative to each other, and a large leakage gap occurs in the crescent-shaped compression chambers defined by plate-like spiral teeth in the radial direction and efficiency extremely lowers due to a leakage loss.

In the conventional scroll compressor of the example 4 as disclosed in Japanese Patent Laid-Open No.Hei 4-231691, the high and low pressure separator 4 is welded to the sealed vessel 9 at a distance from an axial position of the seal face 1q parallel with the base plate of the fixed scroll 1. Since a diametric shrinkage force acts on the weld, the high and low pressure separator after the welding receives a bend moment caused by the shrinkage force and attempts to be deformed. Since the axial positions of the weld and the seal face position of the high and low pressure separator are distant in the conventional scroll compressor, the welding load acting distance on the seal face is long. Thus, the bend moment increases, the seal face is deformed, and the seal characteristic worsens.

In the conventional scroll compressor of the example 3 as disclosed in Japanese Patent Laid-Open No.Sho 63-80088, the upward travel distance of the fixed scroll 1 (in a direction distant from the orbiting scroll 2) is regulated by means of bolts 37 fastened to the frame 3 (strictly, a member sandwiched between the bolts and the frame 3). Thus, when the fixed scroll 1 performs upward relief operation with large acceleration at the liquid compression operation, etc., the fastening force of the bolts 15 fixing the spring plate 12 to the frame 3 is impaired.

Since the scroll compressor similar to the conventional scroll compressor of the example 3 as disclosed in Japanese Patent Laid-Open No.Sho 63-80088 is formed with the intermediate pressure chamber 4a before it is started, for example, when it is started with full liquid wherein the compression chamber is filled with liquid refrigerant, oil or the like, the intermediate pressure chamber 4a becomes intermediate pressure just after the starting, and the fixed scroll 1 is strongly pressed against the orbiting scroll 2. At the time, the tooth tips of the plate-like spiral teeth 1a and 2a of the fixed and orbiting scroll 1 and 2 are seized.

In the conventional scroll compressor of the example 3 as disclosed in Japanese Patent Laid-Open No.Sho 63-80088, the plate spring 12 is made of sheets and is low in axial rigidity and can be displaced by a weak force, but is high in radial rigidity and hard to be displaced in an assembly condition.

When a liquid refrigerant flows into the compression space and is compressed and pressure in the compression space abnormally rises, such a characteristic is advantageous for the fixed scroll 1 to axially move for relieving the pressure in the compression space. As the compressor volume increases, the thickness of the sheet members needs to be increased to provide the strength of the plate spring. However, the axial rigidity is proportional to the cube of the thickness and therefore becomes too strong and the axial relief characteristic worsens.

The scroll compressor similar to the conventional scroll compressor of the example 3 as disclosed in Japanese Patent Laid-Open No.Sho 63-80088 has axial dimensions set so that the spiral tooth tip of the fixed scroll and the spiral tooth bottom of the orbiting scroll and the spiral tooth tip of the orbiting scroll and the spiral tooth bottom of the fixed scroll come in contact with each other almost at the same time. For light weight to decrease vibration, the orbiting scroll often uses a light alloy such as an aluminum alloy. Since the light alloy is soft for iron-family material, wear is prone to develop and wear of the spiral tooth tips increases.

In the conventional scroll compressor of the example 1 as disclosed in Japanese Patent Laid-Open No.Sho 63-80088, the high and low pressure separator 4 is formed with an oil return hole 4e and the frame 3 is also formed with an oil return hole 3f at a position corresponding to the oil return hole 4e. Thus, when the compressor is assembled, the high and low pressure separator 4 and the frame 3 need to be diametrically positioned. In addition, when the high and low pressure separator has a diametrically asymmetric form, diametric positioning is also required. Thus, when the compressor is assembled, alignment is required with jigs and tools and defective positioning or the like also occurs.

In the conventional scroll compressor shown in FIG. 23, the central axial line of the discharge port 1e of the fixed scroll 1 is eccentric with that of the discharge port 4f of the high and low pressure separator 4. Thus, when the refrigerant gas is discharged, a pressure loss, etc., caused by a complicated flow passage form of the discharge ports 1e and 4f provided eccentrically with each other increases, lowering the compression efficiency.

In the conventional scroll compressor shown in FIG. 24, the central axial line of the relief port 29 of the high and low pressure separator 4 is eccentric with that of an extraction hole 1d of a fixed scroll 1. Thus, for example, if the pressure in a compression space 21 abnormally rises, the pressure in the back pressure chamber 4a communicated with the compression chamber 21 through the extraction hole 1d also abnormally rises. However, the operation of the pressure release device 28 when the pressure in the back pressure chamber 4a abnormally rises is delayed because the relief port 29 and the extraction hole 1d are provided eccentrically with each other; pressure release is delayed.

Therefore, the high pressure condition in the back pressure chamber 4a continues for a while, and a force pressing the fixed scroll 1, namely, a press force acting on the orbiting scroll 2 becomes excessive, promoting tooth tip wear of the fixed scroll plate-like spiral tooth 1a and the orbiting scroll plate-like spiral tooth 2a or damaging them.

SUMMARY OF THE INVENTION

The invention was made in order to solve the above-mentioned problems, and it is therefore an object of the invention to provide a scroll compressor which does not create gaps between plate-like spiral teeth and between a tooth tip and a tooth bottom of plate-like spiral teeth and in which guide and pin parts are free from abnormal wear or the like, to thereby achieve high efficiency and high reliability compatible with each other.

An object of the invention is to provide a scroll compressor which is improved in assembly and prevents seal failure from occurring at the seal places.

An object of the invention is to provide a highly reliable scroll compressor which prevents the tooth tip of the plate-like spiral tooth from being seized even at the vacuum operation time.

An object of the invention is to provide a scroll compressor which prevents the paired compression spaces from becoming unbalanced.

An object of the invention to provide a scroll compressor which ensures a stable capability without periodical change of the plate-like spiral tooth and prevents the refrigerant circuit throttle from being clogged with wear particles.

An object of the invention is to provide a high-performance, low-noise scroll compressor wherein the plate spring does not shift, namely, the fixed scroll does not shift even in an operation condition in which an excessive load acts on the spiral at the liquid compression time, etc.

An object of the invention is to provide a high-performance and high-reliability scroll compressor which can make the fixed scroll small in volume, and is good in axial minute follow-up operability of the fixed scroll during the operation.

An object of the invention is to provide a scroll compressor wherein phase between the fixed scroll and the orbiting scroll is accurately adjusted to ensure high efficiency at the steady operation time.

An object of the invention is to provide a scroll compressor which has a good seal characteristic by decreasing deformation of the seal face when the high and low pressure separator is welded to the sealed vessel.

An object of the invention is to provide a high-reliability scroll compressor which is free from damage of parts and fastening failure of parts even when the fixed scroll is upward relieved with large acceleration at the liquid compression operation, etc.

An object of the invention is to provide a high-reliability scroll compressor wherein the tooth tips are not seized when it is started will full liquid wherein the compression chamber is filled with liquid refrigerant, oil or the like.

An object of the invention is to provide a scroll compressor which maintains a good axial relief characteristic even if the compressor volume increases and the plate spring strength is enhanced.

An object of the invention is to reduce wear of the orbiting scroll plate-like spiral tooth tips while being lighten in weight.

An object of the invention is to simply perform positioning of the high and low pressure separator and the frame without use of special assembly jigs, etc.

An object of the invention is to provide a scroll compressor which is good in operation efficiency with less compression loss when a refrigerant gas is discharged.

An object of the invention to provide a scroll compressor with high operation reliability wherein when pressure in a compression space abnormally rises, pressure in a back pressure chamber is released without delay for preventing a failure from occurring.

A scroll compressor of the present invention comprises in a sealed vessel:

- a fixed scroll formed with a plate-like spiral tooth on one side of a base plate of the fixed scroll;
- an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll being combined with the fixed scroll for forming a compression space, and executing orbiting motion with respect to the fixed scroll;
- a frame for axially supporting the orbiting scroll and radially supporting a drive shaft;
- a stationary member fixed to the frame in an arbitrary manner; and
- a seal member disposed in a clearance between the stationary member and the fixed scroll to form a pressure portion which presses the fixed scroll toward the orbiting scroll, wherein:
- an outer peripheral portion of the base plate of the fixed scroll is radially supported by a circular cylinder of the stationary member, the circular cylinder being coaxial with the outer peripheral portion of the base plate of the fixed scroll; and
- the outer peripheral portion of the fixed scroll is axially slidable along the circular cylinder of the stationary member as a guide within a range in which one axial end thereof interferes with the orbiting scroll and the other axial end thereof interferences with the stationary member.

In the scroll compressor, rotation of the fixed scroll with respect to the stationary member is regulated by rotation direction regulation means, and the outer peripheral portion of the base plate of the fixed scroll and the rotation direction regulation means are disposed to almost match in axial position.

In the scroll compressor, rotation of the fixed scroll with respect to the stationary member is regulated by rotation direction regulation means, and a clearance between the fixed scroll and the rotation direction regulation means is made larger than a clearance between the outer peripheral portion of the base plate of the fixed scroll and a sliding portion of the circular cylinder of the stationary member.

A scroll compressor of the invention comprises in a sealed vessel:

- a fixed scroll formed with a plate-like spiral tooth on one side of a base plate of the fixed scroll;
- an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll being combined with the fixed scroll for forming a compression space, and executing orbiting motion with respect to the fixed scroll;

a frame for axially supporting the orbiting scroll and radially supporting a drive shaft;

a stationary member fixed to the frame in an arbitrary manner; and a seal member disposed in a clearance between the stationary member and the fixed scroll to form a pressure portion which presses the fixed scroll toward the orbiting scroll, the fixed scroll enabling to make minute axial motion, wherein:

the seal member is disposed in the clearance between the stationary member and the fixed scroll at a set portion which is formed on a plane parallel with the base plate of the fixed scroll.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll being combined with the fixed scroll for forming a compression space, and executing orbiting motion with respect to the fixed scroll;

a frame for axially supporting the orbiting scroll and radially supporting a drive shaft;

a stationary member fixed to the frame in an arbitrary manner; and a seal member disposed in a clearance between the stationary member and the fixed scroll to form a pressure portion which presses the fixed scroll toward the orbiting scroll, the fixed scroll enabling to make minute axial motion, wherein:

the seal member is in the form of a ring having a joint. The scroll compressor further comprises:

an elastic member which, when set into a ring-like configuration, defines a slope surface decreasing in height from an inner peripheral side thereof to an outer peripheral side thereof and produces a force to enlarge the ring-like configuration, wherein the seal member is mounted onto the slope surface.

A scroll compressor of the invention comprises in a sealed vessel:

a fixed scroll formed with a plate-like spiral tooth on one side of a base plate of the fixed scroll and able to execute axial minute motion with axial direction compliance means;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll; and a frame fixedly supported to the sealed vessel for axially supporting the orbiting scroll and radially supporting a drive shaft, wherein:

an area onto which discharge pressure behind the fixed scroll is applied is substantially as large as a discharge port area.

A scroll compressor of the invention comprises in a sealed vessel:

a fixed scroll formed with a plate-like spiral tooth on one side of a base plate of the fixed scroll and able to execute axial minute motion with axial direction compliance means;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll; and a frame fixedly supported to the sealed vessel for axially supporting the orbiting scroll and radially supporting a drive shaft, wherein:

extraction holes for communicating an intermediate pressure chamber behind the fixed scroll with a compression space defined by the plate-like spiral teeth are provided for paired two pressure chambers, respectively.

A scroll compressor of the invention comprises in a sealed vessel:

a fixed scroll formed with a plate-like spiral tooth on one side of a base plate of the fixed scroll and able to execute axial minute motion with axial direction compliance means;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll; and a frame fixedly supported to the sealed vessel for axially supporting the orbiting scroll and radially supporting a drive shaft, wherein:

a second interference member other than the orbiting scroll for regulating an axial (downward) travel distance of the fixed scroll on the plate-like spiral tooth side of the fixed scroll is provided.

In the scroll compressor, an outer peripheral portion of the base plate of the fixed scroll is supported by a circular cylinder of a stationary member, and the second interference member is made up of an upper end face of an outer peripheral wall of the frame, which interferes with a part of the outer peripheral portion of the base plate of the fixed scroll.

In the scroll compressor, the fixed scroll is coupled to the frame through a plate spring, the second interference member is made up of an upper end face of an outer peripheral wall of the frame, which interferes with a part of the outer peripheral portion of the base plate of the fixed scroll through the plate spring.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through a plate spring, the fixed scroll enabling to make minute axial motion with axial direction compliance means, wherein:

the plate spring and the fixed scroll or the plate spring and the frame are fastened by means of a reamer bolt or a reamer pin, or the plate spring and the fixed scroll or the plate spring and the frame are fastened by means of a reamer pin and a bolt.

In the scroll compressor, the plate spring and the fixed scroll or the plate spring and the frame are fastened by at least two reamer bolts or two reamer pins.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through a plate spring, the fixed scroll enabling to make minute axial motion with axial direction compliance means, wherein:

the plate spring is fixed to a face of a spiral side of the base plate of the fixed scroll.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through plate springs, wherein:

one of the plate springs is fastened to a face, oriented in a spiral direction, of an outer periphery of the base plate of the fixed scroll by a bolt;

the other is fastened to an upper end face of a frame outer peripheral wall surrounding the fixed scroll spiral substantially over its overall height by a bolt; and relief parts are provided at corresponding points of the base plate of the fixed scroll and an upper end face of the frame outer peripheral wall for avoiding interference of heads of the fastening bolts.

In the scroll compressor, the relief parts include a notch, spot facing, or equivalent provided on an outer peripheral portion of the fixed scroll and a notch, spot facing, or equivalent recess provided on the upper end face of the frame outer peripheral wall.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through a plate spring, the fixed scroll enabling to make minute axial motion with axial direction compliance means, wherein:

relative positioning of the fixed scroll and the frame when to be assembled together is ensured by inserting reamer pins into reamer holes formed respectively in the fixed scroll and the frame.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll;

a frame fixedly supported to the sealed vessel for axially supporting the orbiting scroll and radially supporting a drive shaft;

a stationary member located at an opposite side of the fixed scroll with respect to the orbiting scroll and fixed to the sealed vessel; and a seal member for dividing a space between the fixed scroll and the stationary member, wherein:

compressed gas from a compression space applies pressure onto a pressure seal face of the fixed scroll to energize the fixed scroll toward the orbiting scroll; and the stationary member is welded to the sealed vessel near an axial position of the pressure seal face.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll;

a frame fixedly supported to the sealed vessel for axially supporting the orbiting scroll and radially supporting a drive shaft, the frame being coupled to the fixed scroll through a plate spring; and a high and low pressure separator located at an opposite side of the fixed scroll with respect to the orbiting scroll and fixed to the sealed vessel, wherein:

an axial (upward) travel distance of a side of the fixed scroll opposite from a plate-like spiral tooth side is regulated by interference with the high and low pressure separator or a member attached to the high and low pressure separator.

In the scroll compressor, in case the high and low pressure separator is to be fixed to the sealed vessel, the high and low pressure separator is axially positioned by pressing it against the frame or a member attached to the frame.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll;

a frame fixedly supported to the sealed vessel for axially supporting the orbiting scroll and radially supporting a drive shaft, the frame being coupled to the fixed scroll through a plate spring; and a stationary member located at an opposite side of the fixed scroll with respect to the orbiting scroll, wherein:

the rear of the fixed scroll is brought into close contact with the stationary member by an initial pressing force of the plate spring under an operation stop state to provide no intermediate chamber.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through a plate spring, wherein:

the plate spring includes a number of sheet members laminated axially one on another.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through a plate spring, wherein:

the plate spring is sandwiched between an inner peripheral side step part on a plate spring attachment face of the base plate of the fixed scroll and an inner wall face of a sealed shell to regulate diametric displacement.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll;

a frame fixedly supported to the sealed vessel for axially supporting the orbiting scroll and radially supporting a drive shaft; and a stationary member located at an opposite side of the fixed scroll with respect to the orbiting scroll for regulating axial movement of the fixed scroll toward a side opposite from the plate-like spiral tooth of the fixed scroll, wherein:

axial dimensions of spiral teeth of the fixed scroll and the orbiting scroll are set so that a tip of the spiral tooth of the fixed scroll comes in contact with a bottom of the spiral tooth of the orbiting scroll while a tip of the spiral tooth of the orbiting scroll and a bottom of the spiral tooth of the fixed scroll have a minute axial gap during operation.

A scroll compressor of the invention comprises in a sealed vessel:

a fixed scroll formed with a plate-like spiral tooth on one side of a base plate of the fixed scroll;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll;

a frame fixedly supported to the sealed vessel for axially supporting the orbiting scroll and radially supporting a drive shaft, the frame being coupled to the fixed scroll through a plate spring;

a stationary member for regulating axial (upward) movement of the fixed scroll toward a side opposite from the plate-like spiral tooth of the fixed scroll; and means for axially and diametrically positioning the stationary member and the frame.

In the scroll compressor, the axial and diametric positioning means for the stationary member and the frame comprise a plurality of reamer holes formed in a high and low pressure separator, reamer holes formed in the frame at positions corresponding to the reamer holes of the high and low pressure separator, and stepped pins inserted in respective reamer holes.

A scroll compressor of the invention comprises in a sealed vessel:

a fixed scroll formed with a plate-like spiral tooth on one side of a base plate of the fixed scroll and a discharge port at a center of the base plate;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll executing orbiting motion with respect to the fixed scroll;

a frame disposed at an opposite side of the orbiting scroll with respect to the fixed scroll for axially supporting the orbiting scroll and radially supporting a drive shaft;

a stationary member disposed at an opposite side of the fixed scroll with respect to the orbiting scroll, the stationary member being formed with a discharge port coaxial with respect to the discharge port of the fixed scroll and lager in diameter than the discharge portion of the fixed scroll.

In the scroll compressor, the fixed scroll is capable of making axial minute motion with axial direction compliance means.

A scroll compressor of the invention comprises in a sealed vessel:

a fixed scroll formed with a plate-like spiral tooth on one side of a base plate of the fixed scroll, the fixed scroll capable of making axial minute motion with axial direction compliance means;

an orbiting scroll formed with a plate-like spiral tooth of substantially the same form as the plate-like spiral tooth of the fixed scroll on one side of a base plate of the orbiting scroll and a shaft or a bearing for receiving a driving force on an opposite side of the base plate, the orbiting scroll making orbiting motion with respect to the fixed scroll;

a frame for axially supporting the orbiting scroll and radially supporting a drive shaft;

a stationary member disposed at an opposite side of the fixed scroll with respect to the orbiting scroll for prohibiting displacement of the fixed scroll away from the orbiting scroll beyond a predetermined position, the stationary member being provided with a pressure release device made up of a relief port having a center in alignment with a center of an extraction hole arranged in the fixed scroll and a valve for opening and closing the relief port.

The invention has the following features:

An outer peripheral portion of the base plate of the fixed scroll is radially supported by a circular cylinder of the stationary member, which circular cylinder is coaxial with the outer peripheral portion of the base plate of the fixed scroll, and the outer peripheral portion of the fixed scroll is axially slidable along the circular cylinder of the stationary member as a guide within a range in which one axial end thereof interferes with the orbiting scroll and the other axial end thereof interferences with the stationary member. Thus, the place where the fixed scroll is radially supported (the outer peripheral portion of the fixed scroll) is near the radial load acting position of the fixed scroll, so that there exists little moment making the fixed scroll unstable. Since the axial downward position regulation member of the fixed scroll is an orbiting scroll, tooth tip leakage gap is substantially zero.

Rotation of the fixed scroll with respect to the stationary member is regulated by rotation direction regulation means, and the outer peripheral portion of the base plate of the fixed scroll and the rotation direction regulation means are disposed to almost match in axial position. Thus, the axial position supporting a radial load of the fixed scroll matches the axial position restraining rotation (on which couple acts); no moment causing unstable behavior of the fixed scroll is produced.

Rotation of the fixed scroll with respect to the stationary member is regulated by rotation direction regulation means, and a clearance between the fixed scroll and the rotation direction regulation means is made larger than a clearance between the outer peripheral portion of the base plate of the fixed scroll and a sliding portion of the circular cylinder of the stationary member. Thus, the radial load acting on the fixed scroll basically is supported on the outer periphery of the base plate; an excessive load does not act on the rotation regulation means and operability is also good.

The seal member is disposed in the clearance between the stationary member and the fixed scroll at a set portion which is formed on a plane parallel with the base plate of the fixed scroll. Thus, in assembling, the fixed scroll is not diametrically restrained at the seal position. In addition, clearance imbalance of seal place caused by assembly failure does not occur either.

Since a seal member disposed in a clearance between the stationary member and the fixed scroll is in the form of a ring having a joint, the joint can absorb dimensional variation.

An elastic member which, when set into a ring-like configuration, defines a slope surface decreasing in height from an inner peripheral side thereof to an outer peripheral side thereof and produces a force to enlarge the ring-like configuration, wherein the seal member is mounted onto the slope surface. Thus, at a stop condition of the scroll compressor, the elastic member attempts to enlarge radially outwardly due to its elasticity, so that the seal member is raised upwardly by the slope surface and depressed outwardly thereby, whereby it is lightly depressed against a wall surface of a groove accommodating seal member. If the compressor starts under this condition, intermediate pressure and high pressure are both sealed immediately after the start, so that the high pressure are sent behind the seal member, and the seal member is surely brought into pressure contact with the stationary member and the inner wall of the seal member accommodation groove.

An area onto which discharge pressure behind the fixed scroll is applied is substantially as large as a discharge port area. The force which depresses the fixed scroll against the orbiting scroll at the vacuum operation condition can be made relatively small.

Extraction holes for communicating an intermediate pressure chamber behind the fixed scroll with a compression space defined by the plate-like spiral teeth are provided for paired two pressure chambers, respectively. Thus, an abnormal rotation moment does not occur in the fixed scroll or the orbiting scroll, and rotation restraint means such as the Oldham's coupling and rotation regulation means are not damaged due to an excessive load.

A second interference member other than the orbiting scroll for regulating an axial (downward) travel distance of the fixed scroll on the plate-like spiral tooth side of the fixed scroll is provided. Thus, even if the tooth tips of the plate-like spiral teeth wear, the fixed scroll interferes with the second interference member when the distance between the base plate of the fixed scroll and the base plate of the orbiting scroll becomes slightly short, whereby the pressing force to the tooth tips of the plate-like spiral teeth decreases, and wear development of the tooth tips is stopped. Therefore, the stroke volume of the compressor does not decrease with use can be provided.

An outer peripheral portion of the base plate of the fixed scroll is supported by a circular cylinder of a stationary member, and the second interference member is made up of an upper end face of an outer peripheral wall of the frame, which interferes with a part of the outer peripheral portion of the base plate of the fixed scroll. Thus, even though the fixed scroll is axially moved along the circular cylinder of the stationary member as a guide so that the tip of plate-like tooth experiences wearing, the outer periphery of the base plate of the fixed scroll interferes with the upper end face of the outer peripheral wall of the frame when the distance between the base plate of the fixed scroll and the base plate of the orbiting scroll becomes slightly short, whereby the pressing force to the tooth tips of the plate-like spiral teeth decreases, and wear development of the tooth tips is stopped. Therefore, the stroke volume of the compressor does not decrease with use.

The fixed scroll is coupled to the frame through a plate spring, the second interference member is made up of an upper end face of an outer peripheral wall of the frame, which interferes with a part of the outer peripheral portion of the base plate of the fixed scroll through the plate spring. Thus, even though the fixed scroll is axially moved so that the tip of plate-like tooth experiences wearing, the outer periphery of the base plate of the fixed scroll interferes with the upper end face of the outer peripheral wall of the frame when the distance between the base plate of the fixed scroll and the base plate of the orbiting scroll becomes slightly short, whereby the pressing force to the tooth tips of the plate-like spiral teeth decreases, and wear development of the tooth tips is stopped.

In a scroll compressor having a frame coupled to a fixed scroll through a plate spring, the plate spring and the fixed scroll or the plate spring and the frame are fastened by means of a reamer bolt, or the plate spring and the fixed scroll or the plate spring and the frame are fastened by means of a reamer pin and a bolt. Thus, even if an excessive load acts on the fixed scroll at the liquid compression operation, etc., the fixed scroll and the frame are not detached and phase shift and diametric gap that cannot be followed do not occur.

Since the plate spring and the fixed scroll or the plate spring and the frame are fastened by at least two reamer bolts or two reamer pins, even if an excessive load acts on the fixed scroll at the liquid compression operation, etc., the fixed scroll and the frame are not detached.

In a scroll compressor wherein a fixed scroll and a plate spring are coupled together through a plate spring, and the fixed scroll capable of making minute axial motion with axial direction compliance means, the plate spring is fixed to a face of a spiral side of the base plate of the fixed scroll. The scroll compressor becomes free from need to elongate the base plate downwardly which has been required in case where it is fixed to a opposite face from the spiral side. Thus, the volume of the fixed scroll can be lessened and the axial minute follow-up operability of the fixed scroll becomes good, a form error of the parts are well-followed and delay in relief does not occur at the relief time.

In a scroll compressor wherein a fixed scroll and a frame are coupled together through a plate spring, and the fixed scroll is capable of making minute axial motion with axial direction compliance means, one of the plate springs is fastened to a face, oriented in a spiral direction, of an outer periphery of the base plate of the fixed scroll by a bolt, whereas the other is fastened to an upper end face of a frame outer peripheral wall surrounding the fixed scroll spiral substantially over its overall height by a bolt, and, further, relief parts are provided at corresponding points of the base plate of the fixed scroll and an upper end face of the frame outer peripheral wall for avoiding interference of heads of the fastening bolts. Thus, the interference with the heads of the fastening bolts can be prevented by the relief parts, and the fixed scroll can be made small in volume.

Since the relief parts include a notch, spot facing, or equivalent provided on an outer peripheral portion of the fixed scroll and a notch, spot facing, or equivalent recess provided on the upper end face of the frame outer peripheral wall, they are formed easily and the fixed scroll can be made small.

In a scroll compressor wherein a fixed scroll and a frame are coupled together through a plate spring, and the fixed scroll is capable of making minute axial motion with axial direction compliance means, relative positioning of the fixed scroll and the frame when to be assembled together is ensured by inserting reamer pins into reamer holes formed respectively in the fixed scroll and the frame. Accordingly, the fixed scroll and the frame (thus, the orbiting scroll) can be assemble together with the phase therebetween be determined with high accuracy, and a leakage gap in radial direction of a compression space is small.

In a scroll compressor wherein a space between the fixed scroll and the stationary member is divided by a seal member, and compressed gas from a compression space applies pressure onto a pressure seal face of the fixed scroll to energize the fixed scroll toward the orbiting scroll, the stationary member is welded to the sealed vessel near an axial position of the pressure seal face, whereby the bend moment produced by the shrinkage force by welding that acts on the seal plane can be reduced and seal plane deformation can be decreased.

In a scroll compressor provided with a high and low pressure separator fixed to a sealed vessel and a plate spring through which a fixed scroll and an orbiting scroll are coupled together, an axial (upward) travel distance of a side of the fixed scroll opposite from a plate-like spiral tooth side is regulated by interference with the high and low pressure separator or a member attached to the high and low pressure separator. Thus, a strong upward collision of the fixed scroll occurring at the liquid compression time, etc., is received at the high and low pressure separator, and damage to the parts or parts fastening failure is not caused by a collision.

In case a high and low pressure separator regulating an axial (upward) travel distance of a side of the fixed scroll opposite from a plate-like spiral tooth side is to be fixed to the sealed vessel, the high and low pressure separator is axially positioned by pressing it against the frame or a member attached to the frame. Thus, the distance between the high and low pressure separator and the fixed scroll can be easily managed with high accuracy, providing a high-reliability scroll compressor wherein the parallelism of the high and low pressure separator and the fixed scroll can be well managed and a single hit when the fixed scroll collides with the high and low pressure separator is prevented. Further, since the travel distance of the fixed scroll is managed accurately, trouble such that the maximum relief amount is too excessive to provide a compression function at starting does not occur.

In a scroll compressor provided with a stationary member disposed at an opposite side of a fixed scroll with respect to an orbiting scroll, and a plate spring through which the fixed scroll and a frame are coupled together, the rear of the fixed scroll is brought into close contact with the stationary member by an initial pressing force of the plate spring at operation stop state and no intermediate chamber is provided. Thus, the fixed scroll is not strongly pressed against the orbiting scroll just after the compressor is started normally or with full liquid, and the slow start is achieved A plate spring connecting a fixed scroll to a frame includes a number of sheet members laminated axially one on another. Thus, a good axial relief characteristic can be maintained even if the plate spring strength is increased.

In a scroll compressor having a plate spring connecting a fixed scroll to a frame, the plate spring is sandwiched between an inner peripheral side step part on a plate spring attachment face of the base plate of the fixed scroll and an inner wall face of a sealed shell to regulate diametric displacement. Since the plate spring is sandwiched between the inner peripheral side step part on the plate spring attachment face of the base plate of the fixed scroll and the inner wall face of the sealed shell to regulate diametric displacement, the plate spring does not shift even in an operation condition in which an excessive load acts on the spiral at the liquid compression time, etc.

A stationary member for regulating axial movement of the fixed scroll toward a side opposite from the plate-like spiral tooth of the fixed scroll is provided, and axial dimensions of spiral teeth of the fixed scroll and the orbiting scroll are set so that a tip of the spiral tooth of the fixed scroll comes in contact with a bottom of the spiral tooth of the orbiting scroll while a tip of the spiral tooth of the orbiting scroll and a bottom of the spiral tooth of the fixed scroll have a minute axial gap during operation. Thus, even if material whose wear easily develops is used for the orbiting scroll, the spiral tooth tips can be prevented from wearing.

In a scroll compressor in which a fixed scroll is coupled to a frame through a plate spring, and which is provided with a stationary member for regulating axial movement of the fixed scroll toward a side opposite from the plate-like spiral tooth of the fixed scroll, the scroll compressor is further provided with means for axially and diametrically positioning the stationary member and the frame. Thus, accurate positioning can be performed and an assembly error can be prevented.

The axial and diametric positioning means for the stationary member and the frame comprise a plurality of reamer holes formed in a high and low pressure separator, reamer holes formed in the frame at positions corresponding to the reamer holes of the high and low pressure separator, and stepped pins inserted in respective reamer holes. Thus, axial and diametric positioning of the high and low pressure separator and the frame can be performed at the same time.

A discharge port of a stationary member disposed at an opposite side of the fixed scroll with respect to the orbiting scroll is arranged coaxial with respect to a discharge port of a fixed scroll and lager in diameter than the discharge portion of the fixed scroll. Thus, the discharge flow passage of a refrigerant gas defined by the discharge ports of the fixed scroll and the stationary member is simplified, so that the flow passage resistance when a refrigerant gas is discharged lessens, decreasing the pressure loss. Thus, a problem of lowering the compression efficiency due to a pressure loss when a refrigerant gas is discharged is solved.

In a scroll compressor having axial direction compliance means, since a fixed scroll is capable of making minute axial motion with the axial direction compliance means, and a discharge port of a stationary member disposed at an opposite side of the fixed scroll with respect to the orbiting scroll is arranged coaxial with respect to a discharge port of the fixed scroll and lager in diameter than the discharge portion of the fixed scroll, the discharge flow passage of a refrigerant gas defined by the discharge ports of the fixed scroll and the stationary member is simplified, so that the flow passage resistance when a refrigerant gas is discharged lessens, decreasing the pressure loss.

A stationary member is disposed at an opposite side of the fixed scroll with respect to the orbiting scroll for prohibiting displacement of the fixed scroll away from the orbiting scroll beyond a predetermined position, and the stationary member is provided with a pressure release device made up of a relief port having a center in alignment with a center of an extraction hole arranged in the fixed scroll and a valve for opening and closing the relief port. The pressure transmission path from the extraction hole to the pressure release device shortens and the relief port and the extraction hole match in the pressure transmission direction on the pressure transmission path. Thus, if the pressure in the back pressure chamber between the high and low pressure separator and the fixed scroll abnormally rises, the pressure release device operates without delay. This effect can prevent the press force acting on the orbiting scroll from becoming excessive when the pressure in the back pressure chamber abnormally rises, promoting tooth tip wear of the fixed spiral tooth and the orbiting spiral tooth, and damaging them.

DETAILED DESCRIPTION OF THE PREFERRED EMBODIMENTS

Figure 1:
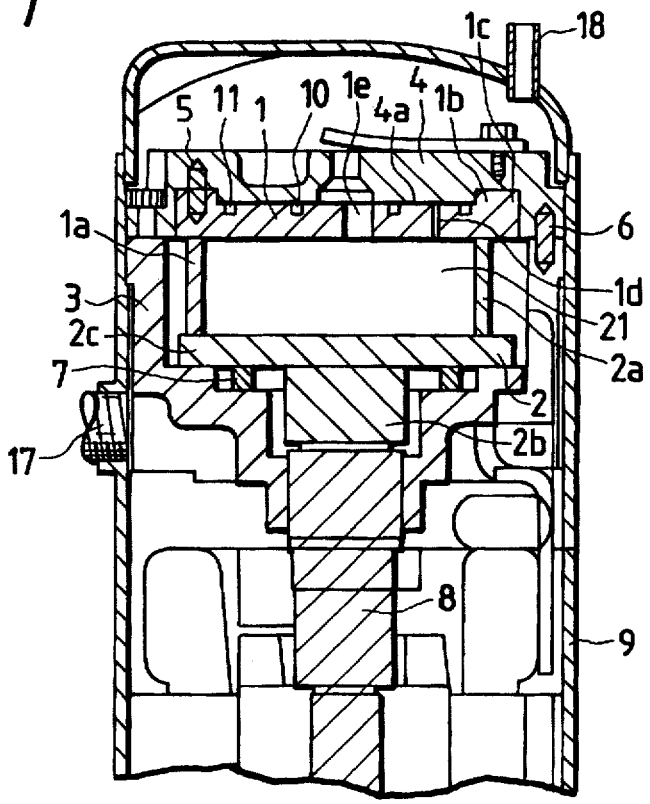
FIG. 1 is a longitudinal sectional view of a scroll compressor according to a first embodiment of the invention.

Referring now to the accompanying drawings, there are shown preferred embodiments of the invention. Parts identical with or similar to those described in the conventional examples and embodiments are denoted by the same reference numerals and will not be discussed again.

Embodiment 1

Figure 2:
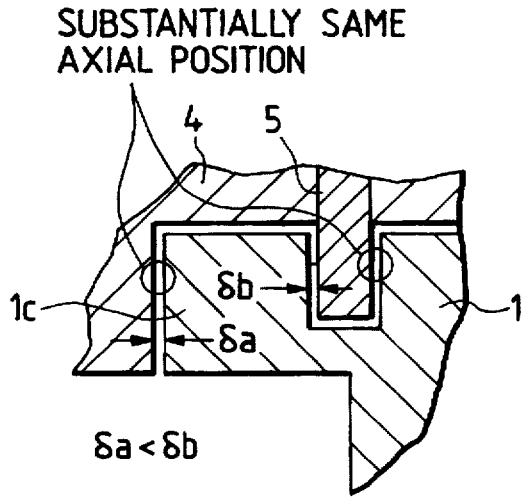
FIG. 2 is an enlarged view of the main part of the scroll compressor according to the first embodiment of the invention.
Figure 3A:
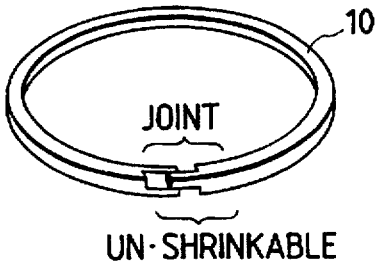
FIGS. 3A and 3B are perspective views for illustrating a seal member and a backup member of the scroll compressor according to the first embodiment, respectively.
Figure 3B:
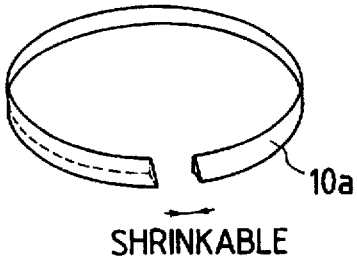
Figure 3C:
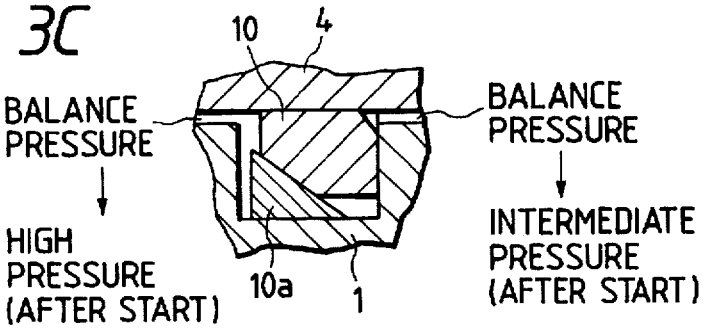
FIG. 3C, 3D and 4 are sectional views for illustrating states of the seal member and the backup member mounted in place.
Figure 3D:
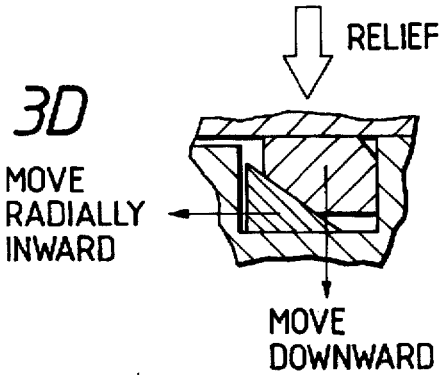
Figure 4:
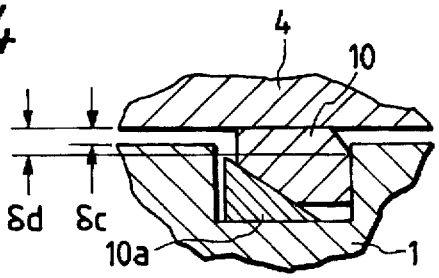

FIG. 1 is a longitudinal sectional view of a scroll compressor according to a first embodiment of the invention. FIG. 2 is a partially enlarged view of the scroll compressor. FIGS. 3A and 3B are perspective views for illustrating a seal member and a backup member of the scroll compressor, respectively, and FIG. 3C, 3D and 4 are sectional views for illustrating states of the seal member and backup member mounted in place.

In FIG. 1, numeral 1 is a fixed scroll having one lower side formed with a plate-like spiral tooth 1*a*, and a base plate 1*b* has an outer peripheral surface 1*c* formed like a cylinder. Grooves for housing an inner seal member 10 for separating high pressure and intermediate pressure and an outer seal member 11 for separating intermediate pressure and low pressure are formed on the opposite face from the plate-like spiral tooth 1*a* (upper side of the fixed scroll 1). Further, an extraction hole 1*d* is formed in the base plate 1*b* of the fixed scroll 1 for guiding gas being compressed (intermediate pressure) to an intermediate pressure chamber 4*a* defined by the fixed scroll base plate 1*b*, a high and low pressure separator 4, and the two seal members 10 and 11.

Numeral 2 is an orbiting scroll having a base plate 2*c* having one upper side formed with a plate-like spiral tooth 2*a*, and a boss part 2*b* receiving a drive force from a spindle 8 is projected on the opposite side (lower side).

Numeral 3 is a frame having an outer peripheral surface stuck to a sealed vessel 9 with high-pressure space above the stuck place and low-pressure space below it. The upper end face of the frame 3 is fastened to the high and low pressure separator 4 (constituting a stationary member) by a bolt. The frame 4 supports a thrust load of the orbiting scroll 2 and supports the spindle 8 radially.

The frame 3 and the high and low pressure separator 4 are positioned in radial and rotation directions by a positioning pin 6 such as a reamer pin, and the fixed scroll 1 is restrained in the rotation directions by a rotation regulation pin or key 5 such as a reamer pin pressed into the high and low pressure separator 4 and constituting a rotational direction regulation means.

The high and low pressure separator 4 is formed with a recess formed like a circular cylinder at the lower part. The fixed scroll base plate is fitted in the recess and a radial load acting on the fixed scroll 1 is transmitted via the fit part to the high and low pressure separator.

Numeral 7 is an Oldham's coupling for restraining rotation of the orbiting scroll 2 and determining a phase between the orbiting scroll 2 and the frame 3.

Numeral 8 is a spindle and torque for driving the orbiting scroll 2 is given from a motor. Numeral 21 is a compression space formed by the plate-like spiral teeth 1*a* and 2*a* by combining the fixed scroll 1 and the orbiting scroll 2. In addition, a plurality of compression spaces, although omitted in FIG. 1, are defined by the plate-like spiral teeth 1*a* and 1*b* similarly to a commonly known scroll compression as explained along the conventional art above.

In FIG. 2, fit clearance δb of the rotation regulation pin 5 is set larger than fit clearance δa of the fixed scroll base plate outer peripheral surface 1*c*. The axial position of the fit of the rotation regulation pin 5 substantially matches that of the fixed scroll outer peripheral surface 1*c*.

Numeral 17 is a suction pipe communicated with a suction port of the compression space via the low-pressure space of the lower half of the sealed vessel separated by the frame 3. Numeral 18 is a discharge pipe communicated with a discharge port 1*e* of the fixed scroll via the high-pressure space of the upper half of the sealed vessel separated by the frame 3.

In FIGS. 3A to 3D, first a backup member 10*a*, an elastic member having a triangular cross section, is placed in the groove formed on the upper end face of the fixed scroll 1, then the inner seal member 10, a pressure seal member having a hexagonal cross section, is placed on the backup member 10*a*. The joint in the inner seal member is cut as a square cross section and hexagonal cross section, and the seal leakage does not occur owing to the provision of the joint shown in FIG. 3A. The inner seal member 10, as best shown in FIG. 4, is chamfered at the upper corner of the outer peripheral surface, and the axial chamfer dimension δd is set larger than the maximum relief amount of the fixed scroll 1, δc. The description on the inner seal member 10 and the backup member 10*a* is also applied to the outer seal member 11 and a backup member 11*a*.

Next, the operation of the scroll compressor of the first embodiment will be discussed. FIG. 1 shows a state of the scroll compressor during the steady operation.

First, an axial force that acts on the fixed scroll 1 will be described. An upward pushing force caused by gas pressure in the compression space acts on the fixed compressor 1. On the other hand, on the rear of the fixed scroll 1, high pressure acts on the center of the inner seal member 10 and intermediate pressure acts on the part exposed to the intermediate pressure chamber 4*a* between the inner seal member 10 and the outer seal member 11; totally, the fixed scroll 1 is pressed lightly downward, namely, against the orbiting scroll 2.

Next, a radial force that acts on the fixed compressor 1 will be described. A radial force mainly caused by gas pressure in the compression space acts on the plate-like spiral tooth 1*a* of the fixed scroll 1. As a rule, the force is transmitted via the fixed scroll base plate outer peripheral surface 1*c* rather than the rotation regulation pin 5 to the high and low pressure separator 4, because the clearance 6*b* of the rotation regulation pin 5 is set larger than the fit clearance δa of the base plate outer peripheral surface 1*c* as described above.

Next, a moment in the rotation direction that acts on the fixed scroll 1 will be described. A moment in the rotation direction mainly caused by gas pressure in the compression space acts on the fixed scroll 1 like the orbiting scroll 2. At the orbiting scroll 2, the moment is received by the Oldham's coupling 7; at the fixed scroll 1, it is received by means of the rotation regulation pin 5. The fixed scroll base plate outer peripheral surface 1*c*, which is a cylindrical fitting, cannot receive the moment as a rule, needless to say.

The phase between the orbiting scroll 2 and the frame 3 of the scroll compressor 1 of the first embodiment is determined by the Oldham's coupling, the phase between the frame 3 and the high and low pressure separator 4 is determined by the positioning pin 6, and the phase between the high and low pressure separator 4 and the fixed scroll 1 is determined by the rotation regulation pin 5. Consequently, the phase between the fixed scroll 1 and the orbiting scroll 2 is securely determined although indirectly.

In FIG. 1, the base plate outer peripheral surface 1*c* of the fixed scroll 1 is supported radially by the high and low pressure separator 4 constituting a stationary member and formed like a circular cylinder coaxial with the base plate outer peripheral surface 1*c*, and with it as a guide, the fixed scroll 1 can make axial movement within the range in which it interferes with the orbiting scroll 2 downward in the axial direction and with the high and low pressure separator 4 upward in the axial direction. Like the high and low pressure separator, the fixed scroll 1 may be supported radially by the frame 3 for guiding axial vertical movement by fitting slidably the base plate outer peripheral surface 1*c* of the fixed scroll 1 into the frame 3 as a stationary member.

In this embodiment, axial compliance means for enabling minute axial motion of the fixed scroll 1 is made up of the gas pressure in the compression chamber 21, which depresses the fixed scroll 1 axially upwardly, the gas pressure behind the fixed scroll 1, which depresses axially downwardly, the circular cylindrical portion of the stationary member 4, which supports the base plate outer peripheral surface 1*c* of the fixed scroll 1 and guides the vertical motion thereof, and the orbiting scroll.

Next, the operation of the seal members will be discussed by taking the seal member 10 as an example. The same is applied to the outer seal member 11. FIGS. 3C and 3D show conditions at stop, and at relief after start, respectively. Since the backup member 10*a*, an elastic member, attempts to widen to the outer peripheral surface (i.e. radially outwardly) by its own elasticity at stop, the inner seal member 10 is picked up and lightly pressed against the high and low pressure separator 4. If the compressor is started in this condition, intermediate pressure and high pressure are sealed just after the start. High pressure travels into the rear of the inner seal member 10, and the inner seal member 10 is more securely pressed against the high and low pressure separator 4. In this case, a condition in which the inner seal member 10 sinks and does not float up at the start does not occur. The condition described with reference to FIG. 3C is also entered at the steady operation time.

At the relief operation, as the pressure in the compression space becomes abnormally large and the fixed scroll 1 approaches the high and low pressure separator 4, the inner seal member 10 sinks. At the time, the inner seal member 10 drops in the groove relatively downward as the form remains unchanged, but the backup member 10*a* shrinks, namely, its diameter lessens by the force of the inner seal member 10.

The upper corner on the outer peripheral surface of the seal member 10 minutely deforms in the outer peripheral direction due to the pressure difference, but is chamfered. Thus, it is not sandwiched between the fixed scroll 1 and the high and low pressure separator 4 at the relief operation.

Although the ring spring having a triangular cross section is used as the elastic member in the first embodiment, a similar effect is also produced with a wave spring, etc.

The configurations of the seal member 10 and the backup member 10*a* are not restricted to those shown in FIGS. 3A to 3D, and 4. The backup member 10*a* may have any configuration as long as it is in the form of a ring and has an upper slope surface which is gradually smaller in height from the ring inner periphery to the outer periphery, a surface which receive the pressure of the high pressure side within a groove accommodating the seal member, and a surface which contacts the bottom of the groove and is movable on that bottom. As to the seal member 10, it may have any configuration as long as it is in the form of a ring and has a surface which is to be mounted onto the upper slope surface of the backup member 10*a* and surfaces which are brought into tight contact with a lower surface of the high and low pressure separator and a surface of low pressure side of the groove, respectively, when it is depressed toward the ring outer periphery through the slope surface by the backup member 10*a*.

Embodiment 2

Figure 5:
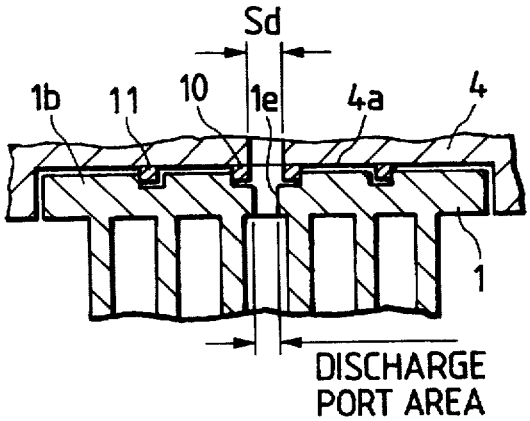
FIG. 5 is a sectional view of the main part of a scroll compressor according to a second embodiment of the invention.

FIG. 5 is a sectional view for illustrating a scroll compressor according to a second embodiment of the invention, and particularly shows, in section, major portions of sealing portions between a fixed scroll 1 and a stationary member 4 of the scroll compressor the entire construction of which is the same as that shown in FIG. 1. In FIG. 5, a groove for housing an inner seal member 10 located on the upper end face of a base plate 1*b* of a fixed scroll 1 is formed integrally with a discharge port 1*e* of the fixed scroll 1. Therefore, the inner seal member 10 has almost the same inner diameter as the diameter of the discharge port 1*e*.

If a valve of a suction pipe 17 is failed to open or the like at initial start operation, so-called vacuum operation in which low pressure (suction pressure) becomes close to vacuum occurs. At the time, intermediate pressure is also made a considerably small value by the effect of the low pressure close to vacuum, thus a force that acts on the fixed scroll 1 is determined almost by the area (around the center) on which high pressure on the rear of the fixed scroll base plate 1*b* acts. In the scroll compressor of the second embodiment, the diameter of the inner seal member 10 is set small, so that the force pressing the fixed scroll 1 against an orbiting scroll 2 is small, and the axial relief state may be entered before vacuum is reached in some cases; vacuum is not reached. Therefore, at the vacuum operation, the fixed scroll 1 is not strongly pressed against the orbiting scroll 2.

Figure 9:
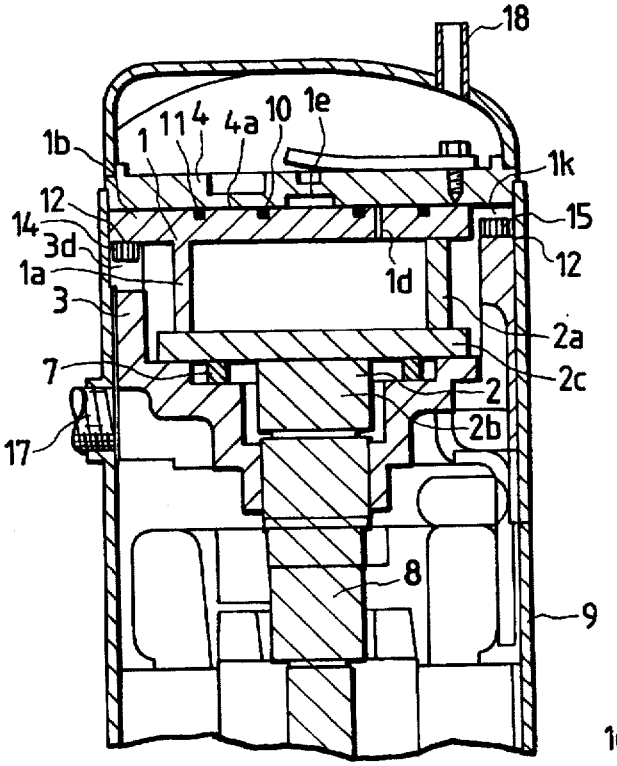
FIG. 9 is a longitudinal sectional view of a scroll compressor according to a sixth embodiment of the invention.

In addition, the similar function and effect can also be obtained if the construction of the groove of the fixed scroll for housing the inner seal member 10 and the construction of the discharge portion 1*e* in this embodiment are applied to a scroll compressor having a leaf spring explained latter with reference to FIG. 9.

Embodiment 3

Figure 6:
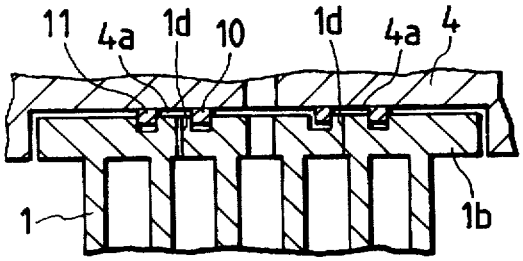
FIG. 6 is a sectional view of the main part of a scroll compressor according to a third embodiment of the invention.

FIG. 6 is a sectional view for illustrating a scroll compressor according to a third embodiment of the invention, and particularly shows, in section, major portions of sealing portion between a fixed scroll 1 and a stationary member 4 and of a compression space of the scroll compressor the entire construction of which is the same as that shown in FIG. 1. In FIG. 6, two extraction holes 1*d* communicating a pair of compression spaces and an intermediate pressure chamber 4*a* with each other are made in a base plate 1*b* of a fixed scroll 1. The two extraction holes 1*d* are located at the same position for the paired compression spaces.

The scroll compressor performs the compression operation by decreasing the volume of the paired crescent-shaped compression spaces. Since two extraction holes exist, the paired compression spaces are communicated via the intermediate pressure chamber 4*a*, so that unbalancing the two compression spaces is avoided.

Figure 8A:
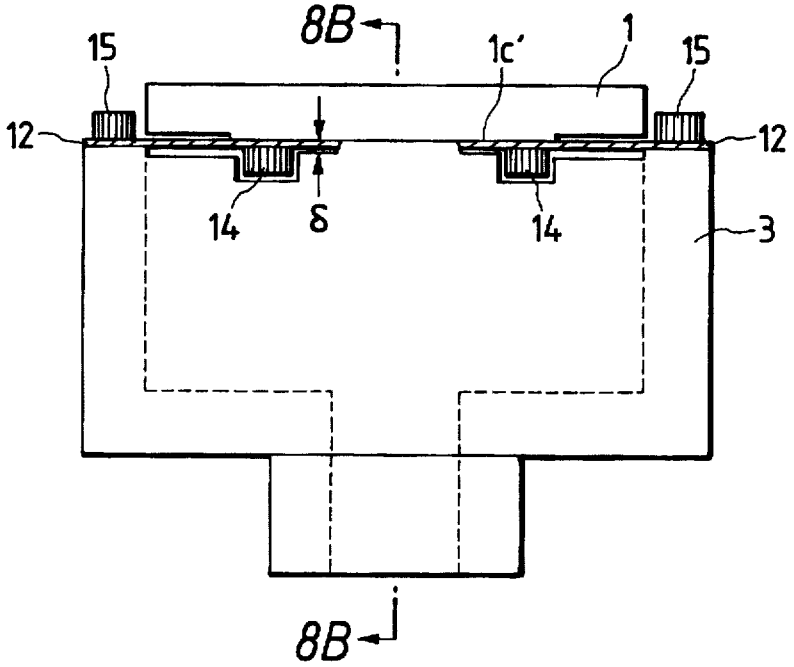
FIG. 8A is a sectional view for illustrating a scroll compressor according to a fifth embodiment of the invention.
Figure 8B:
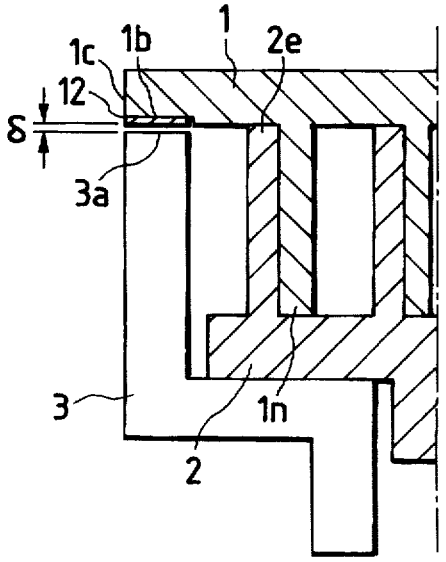
FIG. 8B is also a sectional view taken along line 8B—8B of FIG. 8A.

In addition, the same function and effect can also be obtained if the construction wherein the extraction holes 1*d* are respectively formed for the paired compression spaces is applied to a scroll compressor having a leaf spring explained latter with reference to FIGS. 8A and 8B.

Embodiment 4

Figure 7:
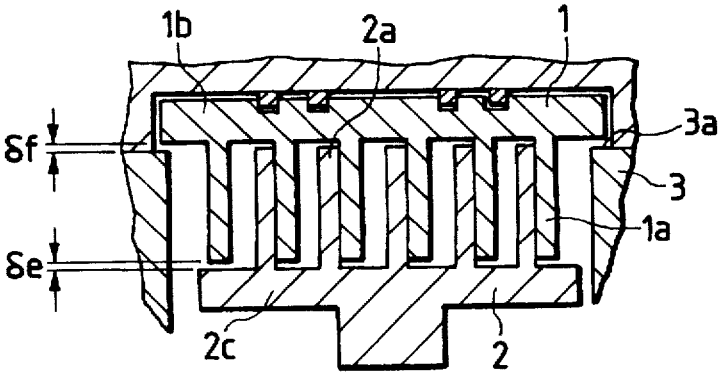
FIG. 7 is a sectional view of the main part of a scroll compressor according to a fourth embodiment of the invention.

FIG. 7 is a sectional view for illustrating a scroll compressor according to a fourth embodiment of the invention, the entire construction of which is the same as that shown in FIG. 1. In FIG. 7, when the distance between the tip of a plate-like spiral tooth 1*a* of a fixed scroll 1, namely, tooth tip and the upper end face of a base plate 2*c* of an orbiting scroll 2, namely, tooth bottom, δe, is zero, the distance between the tip of a plate-like spiral tooth 2*a* of the orbiting scroll 2, namely, tooth tip and the upper end face of a frame 3, δf, is controlled between 5 μm and several ten μm. The outer form of a base plate 1*b* of the fixed scroll 1 is set larger than the inner diameter of the frame 3.

Thus, even if the tooth tip wears due to slide, the wearing does not develop endlessly. After it wears to some extent, the tooth bottom of the fixed scroll 1 and the upper end face 3*a* of the frame 3 (second interference member) are pressed against each other. As a result, a substantial gap does not exist and a force does not act either between the tooth tip of the fixed scroll 1 and the tooth bottom of the orbiting scroll 2 or the tooth bottom of the fixed scroll 1 and the tooth tip of the orbiting scroll 2. That is, after the scroll compressor is used for a long term, the stroke volume of the compressor does not reduce or a large amount of wear powder is not produced.

Embodiment 5

FIG. 8A is a sectional view for illustrating a scroll compressor according to a fifth embodiment of the invention, and FIG. 8B is also a sectional view taken along line 8B—8B of FIG. 8A, the entire construction of which is the same as that shown in FIG. 1. In FIGS. 8A and 8B, a base plate outer peripheral surface 1*c* of a fixed scroll 1 has a positional relationship 1*c*' overlapping with a frame outer peripheral wall upper end face 3*a* with a plate spring 12 therebetween; their dimensional relationships are set so that a minute gap δ exists axially when the fixed scroll 1 is in contact with an orbiting scroll 2.

When the distance between the fixed scroll 1 and the orbiting scroll 2 becomes close due to wear of tooth tips 2*e* and 1*n* of spiral teeth after the operation for a long time, fixed scroll base plate 1*b* comes in contact with the frame outer peripheral wall upper end face 3*a* with the plate spring 12 therebetween, whereby the pressing force of the fixed scroll 1 shares a part on the frame outer peripheral wall upper end face 3*a* and the pressing force of the tooth tips 2*e* and 1*n* of the spiral teeth decreases, stopping wear development of the tooth tips.

Embodiment 6

Figure 10:
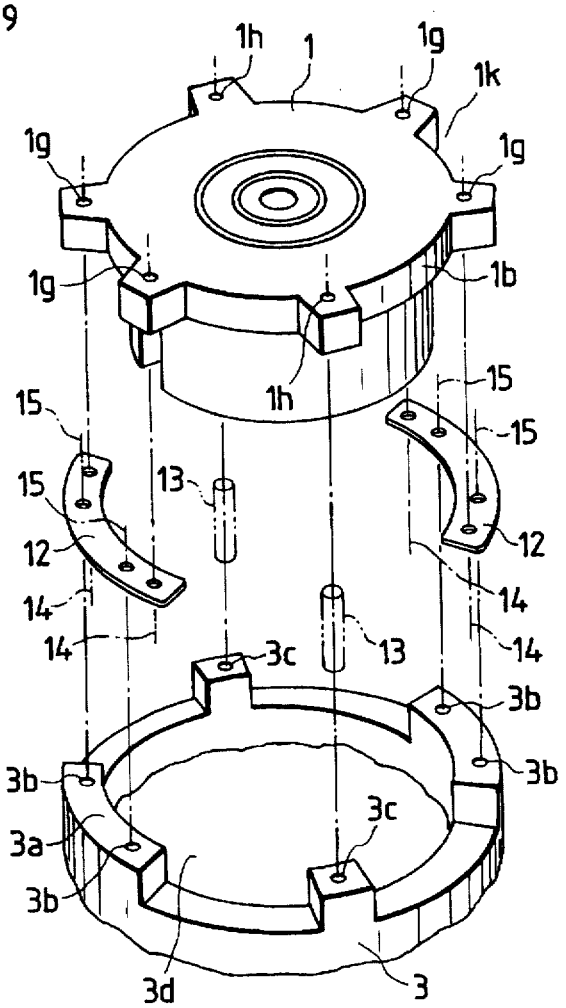
FIG. 10 is a perspective view of the main part of a scroll compressor according to the sixth embodiment of the invention.

FIG. 9 is a longitudinal sectional view of a scroll compressor according to a sixth embodiment of the invention. FIG. 10 is a perspective view of parts related to the sixth embodiment.

The structure and operation of the sixth embodiment will be discussed with reference to FIGS. 9 and 10. Parts identical with or similar to those previously described with reference to FIGS. 1 to 4 are denoted by the same reference numerals in FIGS. 9 and 10 and will not be discussed again. Numeral 1 is a fixed scroll and four reamer bolt screw holes 1*g* and two reamer holes 1*h* are formed around the outer peripheral surface of a base plate 1*b*. Numeral 12 is plate or leaf springs each formed with four reamer holes. Reamer bolts 14 are inserted into the two reamer holes at both ends of the plate spring 12 for fixing it to the end face on the outer peripheral spiral side of the fixed scroll 1. Reamer bolts 15 are inserted into the two reamer holes at the center of the plate spring 12 for fixing it to an upper end face 3*a* of a frame 3.

The reamer bolt (reamer pin) is one machined having high accuracy in diametrical dimension (about 10 μm allowable tolerance), so that it is possible to establish dimensional relationship required to assemble the components even if clearance of hole dimension on the plate spring side is set small. In this case, even if a shift or displacement occurs between the plate spring and the fixed scroll or the frame, the reamer bolt and the mating plate spring hole interfere to each other within a minute displacement (within the clearance) to prevent the further displacement beyond the minute displacement. Thus, the displacement can be restricted to a small, minute amount, and such displacement can not adversely affect operation of the compressor substantively.

Since the fixed scroll 1 is completely restrained physically with respect to translational motion with the plate spring 12 by the reamer bolts 14, even if an excessive load acts on the fixed scroll 1 because of liquid compression, etc., the fixed scroll 1 and the spring plate 12 do not shift in a translational direction within a plane. Likewise, since the plate spring 12 is completely restrained physically with respect to translational motion with frame 3 by the reamer bolts 15, even if an excessive load is transmitted from the fixed scroll 1 to the plate spring 12 because of liquid compression, etc., the spring plate 12 and the frame 3 do not shift in a translational direction within a plane. In addition, two reamer bolts fixing the plate spring 12 to the fixed scroll 1 and two reamer bolts fixing the plate spring 12 to the frame 3 are provided, thus a rotation moment around the axis does not cause them to shift in the rotation direction. Although the fixed scroll 1 and the frame 3 are elastically coupled axially by the plate spring 12, but physically fixed in radial direction and rotation direction around the axis and do not shift during the operation.

Since the plate spring 12 is engaged in the end face of the spiral side of the fixed scroll 1, the female screw parts of the reamer bolts 14 used for the engagement can be formed around the outer peripheral surface of the base plate 1*b* of the fixed scroll 1, so that the total weight of the fixed scroll 1 can be lessened. As a result, axial minute follow-up operability of the fixed scroll 1 is improved.

The plate spring and the fixed scroll or the plate spring and the frame are fastened by the reamer bolts, but may be fastened by reamer pins and bolts.

At assembly, namely, when the fixed scroll and the spring plate which are fastened by the bolts are fastened to the frame by the reamer bolts, reamer pins 13 are inserted into a reamer hole 1*h* of the fixed scroll 1 and a reamer hole 3*c* of the frame 3, whereby the fixed scroll 1, the frame 3, and orbiting scroll 2 are assembled in a condition in which phase is determined accurately. The reamer pins 13 are removed after completion of the assembly.

In this embodiment, compliance means for enabling minute axial motion of the fixed scroll 1 include the plate spring 12 coupling the fixed scroll 1 to the frame 3 in place of the cylindrical portion of the stationary member 4 supporting the base plate outer periphery 1*c* and guiding vertical motion thereof in the first embodiment.

Embodiment 7

Figure 11:
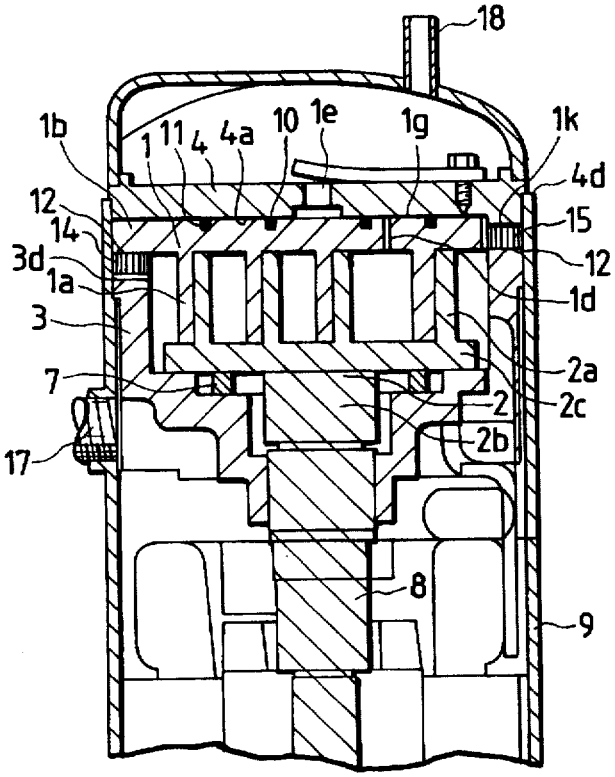
FIG. 11 is a longitudinal sectional view of the main part of scroll compressors according to seventh and eighth embodiments of the invention.
Figure 12:
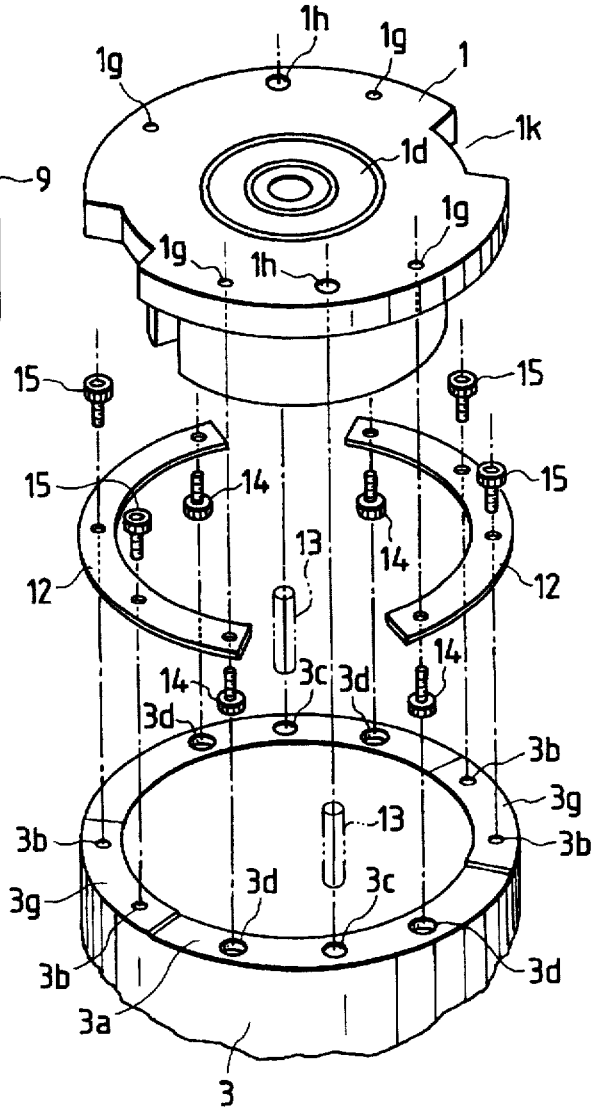
FIG. 12 is a perspective view of the main part of a scroll compressor according to a seventh embodiment of the invention.

FIGS. 11 and 12 are a longitudinal sectional view of a scroll compressor according to a seventh embodiment of the invention and a perspective view of the main part thereof. In FIGS. 11 and 12, numeral 1 is a fixed scroll and numeral 1*d* is an extraction hole for guiding intermediate pressure to an intermediate pressure chamber 4*a* which is formed by separating a space between a fixed scroll base plate 1*b* and a high and low pressure separator 4 by an inner seal member 10 and an outer seal member 11. An axial load that acts on the fixed scroll 1 to be pressed against an orbiting scroll 2 by a small force is produced by adjusting a force pressing the fixed scroll 1 against the high and low pressure separator 4 produced by the compression operation and a force releasing the fixed scroll 1 from the high and low pressure separator 4 that acts on the inner peripheral space of the inner seal member 10 and the intermediate pressure chamber 4*a*. With bolts 14 inserted into screw holes 1*g* of the fixed scroll 1, the plate spring 12 is fastened to the spiral side face of the fixed scroll base plate 1*b*. Further, with bolts 15 inserted into bolt holes 3*b* of the frame 3, the plate spring 12 is fastened to a frame outer peripheral wall upper end face 3*a* of the frame 3 from the top. The frame 3 and the fixed scroll 1 are positioned by inserting reamer pins 13 as jigs into reamer holes 3*c* and 1*h*. After they are fastened by the bolts 15, the reamer pins 13 are removed.

The frame 3 is formed with relief parts 3*d* for avoiding interference of the heads of the bolts 15. Each of the relief parts 3*d* is formed like a minimum necessary notch, spot facing, or equivalent recess to maximize the function of the frame outer peripheral wall as a strength member. The base plate outer peripheral surface of the fixed scroll 1 also has a relief part 1*k* for avoiding interference of the heads of the bolts 15. An attachment face 3*g* of the plate spring 12 is slightly higher than the frame end face 3*a* for allowing downward deformation of the spring.

The plate spring fastening part of the fixed scroll 1 has the structure as described above, whereby the weight of the base plate can be reduced, lessening the total weight of the fixed scroll 1. As a result, axial minute follow-up operability of the fixed scroll 1 can be improved.

In FIG. 11, numeral 1*e* is a discharge port of the fixed scroll 1, numeral 17 is a suction pipe, and numeral 18 is a discharge pipe.

In addition, relief parts 1*k* and 3*d* similar to those of the seventh embodiment are formed in the sixth embodiment as shown in FIGS. 9 and 10.

Embodiment 8

FIG. 11 is a sectional view showing a scroll compressor according to an eighth embodiment of the invention. A high and low pressure separator 4 is welded to a sealed vessel 9 near an axial position of a seal face 1*q* parallel with a base plate of a fixed scroll 1. Thus, a bend moment at welding that acts on a seal face of the high and low pressure separator 4 is reduced and deformation of the seal face can be decreased.

Although the fixing for the high and low pressure separator 4 is performed by the tightening of the bolt to the upper end face of the frame in the first embodiment, the same effect as that of this embodiment can be obtained if the fixing may be performed in the same manner as that of this embodiment.

Embodiment 9

Figure 13A:
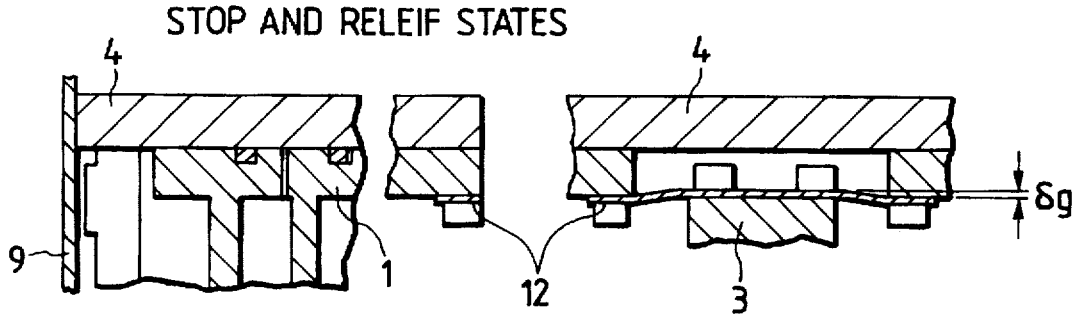
FIGS. 13A and 13B are sectional views of the main part of a scroll compressor according to a ninth embodiment of the invention.
Figure 13B:
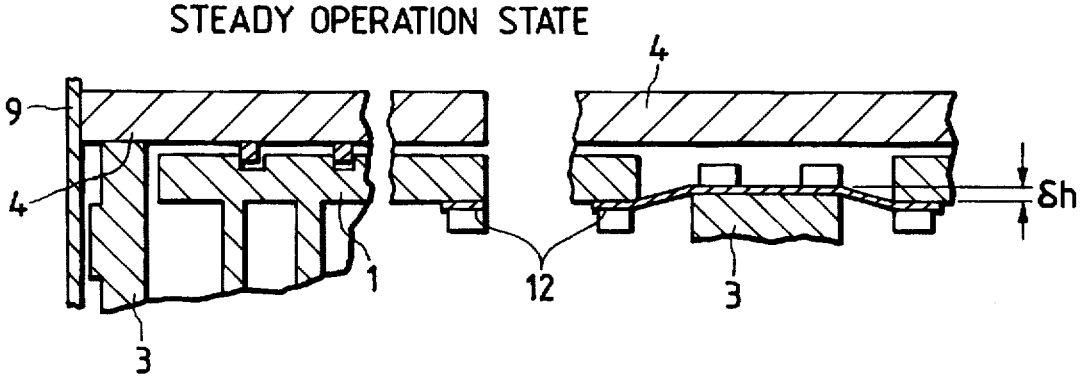

FIG. 13A and 13B are sectional views for illustrating a scroll compressor according to a ninth embodiment of the invention, and particularly shows, in section, main portions of a scroll compressor under releif and stop states (FIG. 13A), and steady state (FIG. 13B) of a plate spring. The entire construction of the scroll compressor is the same as that shown in FIG. 9 and 11. In FIGS. 13A, when a fixed scroll 1 is at the upper position, namely, when the fixed scroll 1 is completely relieved axially, the face on which a plate spring 12 engages the fixed scroll 1 is positioned below the face on which the plate spring 12 engages a frame 3. This distance is $\delta g$ shown in FIG. 13A. Thus, the fixed scroll 1 closely contacts a high and low pressure separator 4 when it stops, namely, no gas load acts. Deflection amount of the plate spring 12 at steady operation, $\delta h$, is the sum of maximum relief amount $\delta c$ and initial deflection amount $\delta g$.

In this embodiment, means for restraining an axial upward move of the fixed scroll 1 is the high and low pressure separator 4 constituting the stationary member. Even if the fixed scroll 1 is relieved upward with large acceleration due to liquid compression, etc., and collides with the high and low pressure separator 4, the high and low pressure separator 4 is strongly fixed to a sealed vessel 9 by welding all around, etc., so that trouble such that the high and low pressure separator 4 is detached does not occur.

In the stop state, the fixed scroll 1 closely contacts the high and low pressure separator 4. As a result, an intermediate pressure chamber 4*a* formed by the fixed scroll 1 and the high and low pressure separator 4 does not exist (the volume is zero). Thus, at start at which liquid compression occurs containing start with full liquid, generation of a force downward pressing the fixed scroll 1 caused by pressure rise in the intermediate pressure chamber 4*a* is delayed and the compressor is smoothly started, preventing trouble such as start failure or compression element damage from occurring.

In FIG. 11, the high and low pressure separator 4 is welded all around to the sealed vessel 9 with the separator 4 pressed against the upper end face of the frame 3. Thus, the maximum relief amount of the fixed scroll 1, $\delta c$, can be managed only by managing the dimensions of the frame 3, an orbiting scroll 2, and the fixed scroll 1. Therefore, the maximum relief amount $\delta c$ can be managed comparatively highly accurately; trouble such that at relief collision, parts are damaged or that the relief amount is too large to start (compress) does not occur.

Embodiment 10

Figure 14:
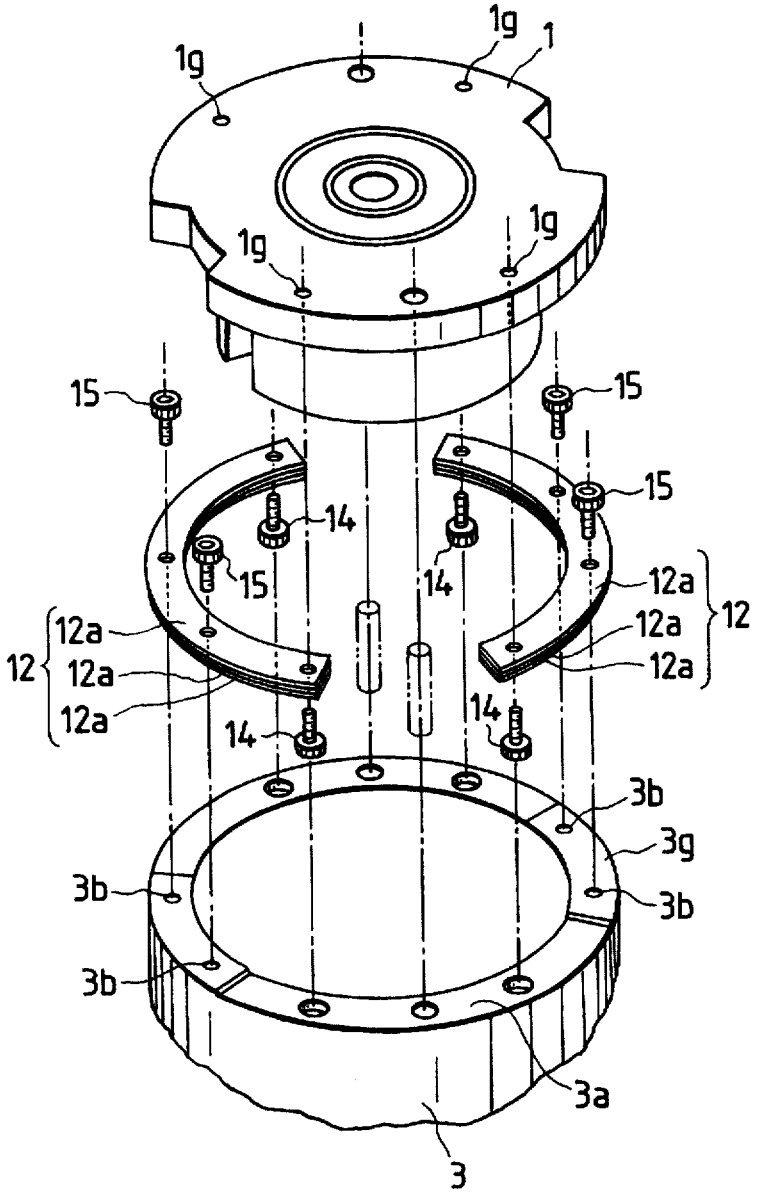
FIG. 14 is a perspective view of the main part of a scroll compressor according to a tenth embodiment of the invention.

FIG. 14 is a sectional view showing a scroll compressor the entire construction of which is the same as that shown in FIGS. 9 and 11. In FIG. 14, numeral 1 is a fixed scroll, numeral 3 is a frame, and numeral 12 is plate springs. The plate spring 12 is fastened in fixed scroll screw holes 1*g* by bolts 14 from the bottom. Further, the plate spring 12 is fastened to a frame outer peripheral wall upper end face 3*a* via bolt holes 3*b* by bolts 15 from the top. The plate spring 12 comprises a plurality of sheet springs 12 laminated on each other; it has sufficient diametric rigidity and can suppress axial rigidity. Generally, the axial rigidity becomes $n^3$ times when the thickness becomes n times, whereas it becomes substantially n times when n number of sheets are stacked one on another to provide the n-time thickness as a whole. Note that the diametric rigidity becomes n times in either of the cases.

Embodiment 11

Figure 15:
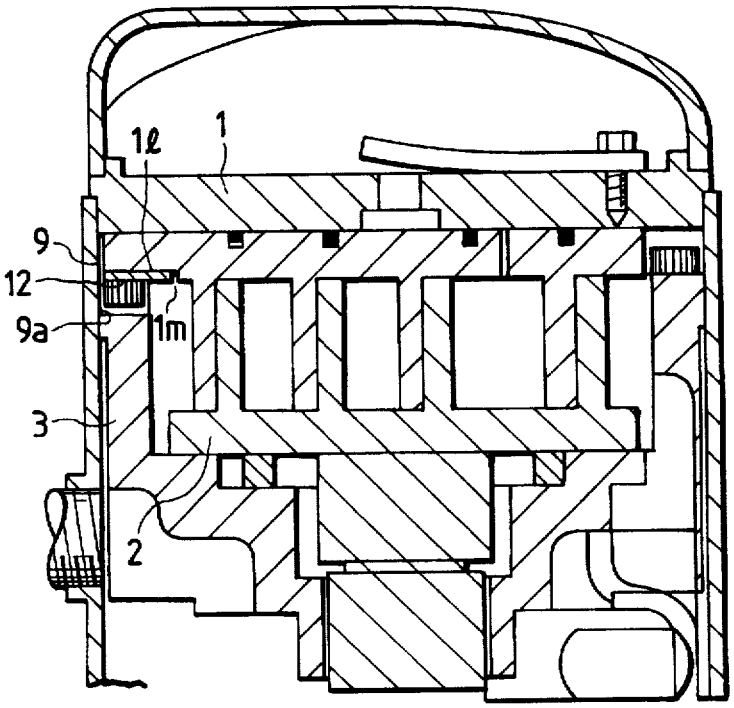
FIG. 15 is a sectional view of the main part of a scroll compressor according to an eleventh embodiment of the invention.

FIG. 15 is a sectional view showing main portions of a scroll compressor the entire construction of which is the same as that shown in FIGS. 9 and 11. In FIG. 15, a plate spring attachment face 11 of a fixed scroll 1 is formed with an inner peripheral side step part 1*m* for regulating displacement of a plate spring 12 to the inner peripheral side.

Further, a sealed shell inner wall face 9*a* is provided for regulating displacement of the plate spring 12 to the outer peripheral side.

Thus, displacement of the spring plate 12 to the inner and outer peripheral sides is regulated and diametric displacement of the spring plate 12 within a setup range is only allowed, whereby even if the plate spring 12 shifts from the fixed scroll 1 or the frame attachment face, the shift amount is regulated, preventing performance from lowering or noise from increasing.

Embodiment 12

Figure 16:
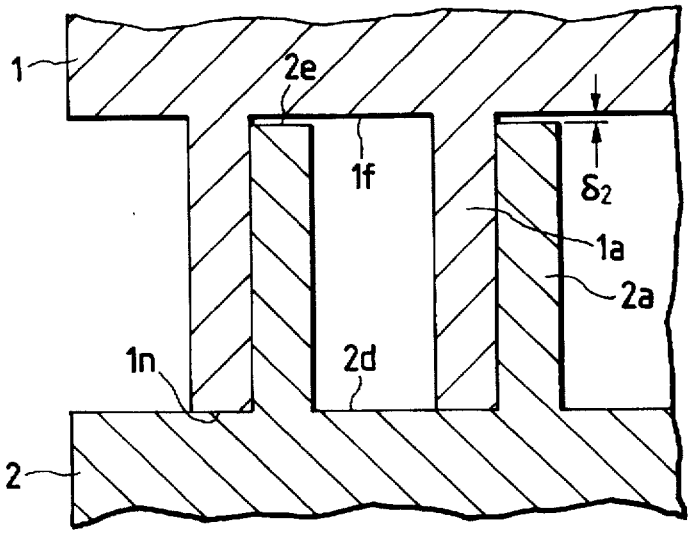
FIG. 16 is a sectional view of the main part of a scroll compressor according to a twelfth embodiment of the invention.

FIG. 16 is a sectional view showing main portions of a scroll compressor, and particularly shows a state of spiral tooth 1*a* of a fixed scroll and a spiral tooth 2*a* of an orbiting scroll of the scroll compressor. The entire construction of the scroll compressor shown in FIG. 16 is the same as that shown in FIGS. 1 and 9. FIG. 16 shows a contact state of plate-like spiral teeth 1*a* and 2*a* during the operation, wherein numeral 1 is a fixed scroll 1 and numeral 2 is an orbiting scroll.

The operation is performed while a spiral tooth tip 1*n* of the fixed scroll 1 comes in contact with a spiral tooth bottom 2*d* of the orbiting scroll 2. On the other hand, a minute gap 62 exists between a spiral tooth tip 2*e* of the orbiting scroll 2 and a spiral tooth bottom 1*f* of the fixed scroll 1. Such dimensional relationships among them enable delaying wear development of orbiting spiral. Particularly, the orbiting scroll can be made of a light alloy material to thereby make it light in weight and to achieve reduction of vibration.

In addition, the construction of this embodiment can be effectively applied to a type wherein a fixed scroll is fixedly provided as well as a type wherein a fixed scroll is capable of performing minute motion in the axial direction.

Embodiment 13

Figure 17:
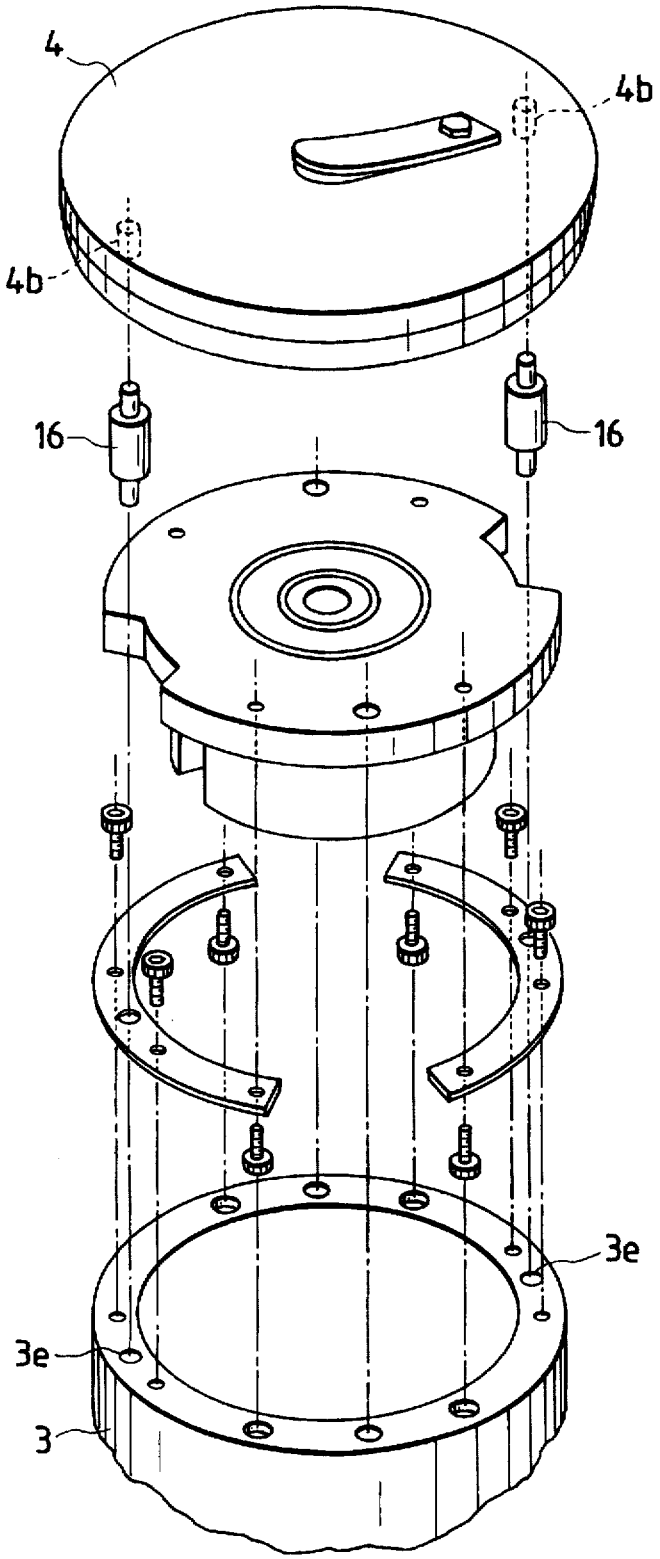
FIG. 17 is a perspective view of the main part of a scroll compressor according to a thirteenth embodiment of the invention.

FIG. 17 is a sectional view showing main portions of a scroll compressor the entire construction of which is the same as that shown in FIGS. 9 and 11. In FIG. 17, a frame 3 is formed with a plurality of reamer holes 3*e*. Further, a high and low pressure separator 4 is formed with reamer holes 4*b* at positions relative to 3*e*.

Numeral 16 is stepped pins engaging the reamer holes 3*e* and 4*b*. Each stepped pin has a step part larger than the reamer hole diameter at the part corresponding to the axial dimension between the frame 3 and the high and low pressure separator 4.

The reamer holes 3*e* and 4*b* and the stepped pins 16 enable easy determination of diametric and axial positions of the frame 3 and the high and low pressure separator 4, improving assembly workability and accuracy.

Embodiment 14

Figure 18:
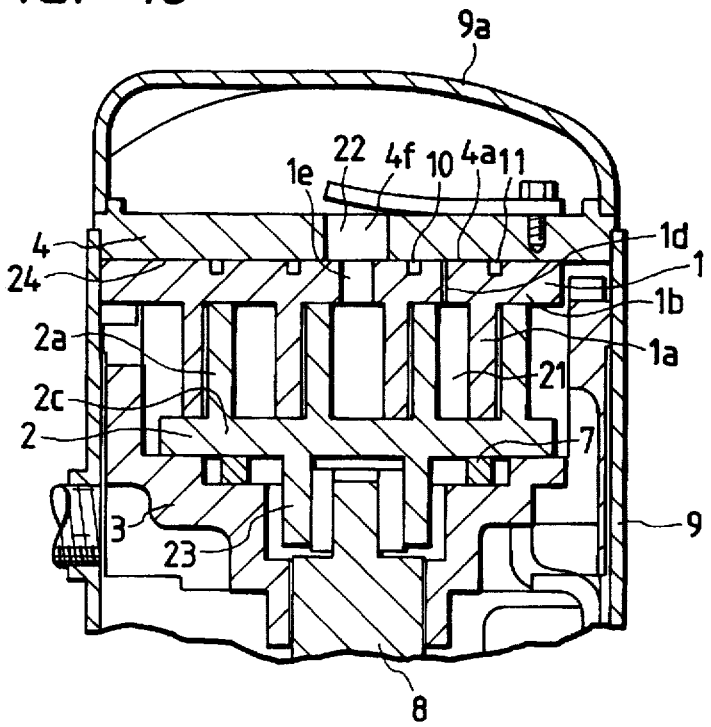
FIG. 18 is a longitudinal sectional view of a scroll compressor according to a fourteenth embodiment of the invention.

FIG. 18 is a longitudinal sectional view of the main part showing a first embodiment of the invention, wherein numeral 9 is a sealed vessel and numeral 1 is a fixed scroll provided with a base plate 1*b* placed to one end face 9*a* in the sealed vessel 9 and disposed displacably in a central axial direction of the sealed vessel 9, a fixed scroll plate-like spiral tooth 1*a* formed on the side of the base plate 1*b* opposed from the end face 9*a*, and a discharge port 1*e* placed at the center of the base plate 1*b*.

Numeral 2 is an orbiting scroll provided with an orbiting scroll plate-like spiral tooth 2*a* disposed on a base plate 2*c* facing the fixed scroll plate-like spiral tooth 1*a* and engaging the fixed scroll plate-like spiral tooth 1*a* for forming a compression space 21 and a boss 23 disposed on the side of the base plate 2*a* opposed from the orbiting scroll plate-like spiral tooth 12.

Numeral 3 is a frame which has an outer peripheral surface fixed in the sealed vessel 9 and is placed on the side of the orbiting scroll 2 opposed from the fixed scroll 1.

Numeral 4 is a high and low pressure separator constituting a stationary member, which is fixed between the fixed scroll 1 and the end face 9*a* of the sealed vessel 9 and placed facing the base plate 1*b* of the fixed scroll 1 for blocking displacement in a direction in which the fixed scroll 1 approaches the end face 9*a* at a predetermined position. Numeral 4*f* is a discharge port which is disposed at the center of the high and low pressure separator 4 and placed concentrically with the discharge port 1*e* of the fixed scroll 1 and has a bore larger than the bore of the discharge port 1*e* of the fixed scroll 1.

Numeral 10 is a seal member provided between the high and low pressure separator 4 and the base plate 1*b* of the fixed scroll 1. Numeral 11 is a seal member provided between the high and low pressure separator 4 and the base plate 1*b* of the fixed scroll 1 and placed outside the seal member 10. Numeral 22 is a high pressure chamber formed in the discharge port 4*f* of the high and low pressure separator 4.

Numeral 4*a* is an intermediate pressure chamber, i.e. a back pressure chamber, formed between the seal members 10 and 11 provided between the high and low pressure separator 4 and the base plate 1*b* of the fixed scroll 1.

Numeral 24 is a low pressure chamber formed between the sealed vessel 9 and outside of the fixed scroll 1 and the orbiting scroll 2.

Numeral 1*d* is an extraction hole formed in the base plate 1*b* of the fixed scroll 1 and communicated with the compression space 21 and the back pressure chamber 4*a*. Numeral 7 is an Oldham's coupling disposed between the base plate 2*c* of the orbiting scroll 2 and the frame 3 for restraining the rotation of the orbiting scroll 2 and positioning the orbiting scroll 2 and the frame 3.

Numeral 8 is a shaft of an electric motor (not shown) provided in the sealed vessel 9 and fitted in the boss 23 of the orbiting scroll 2 for driving the orbiting scroll 2.

Figure 23:
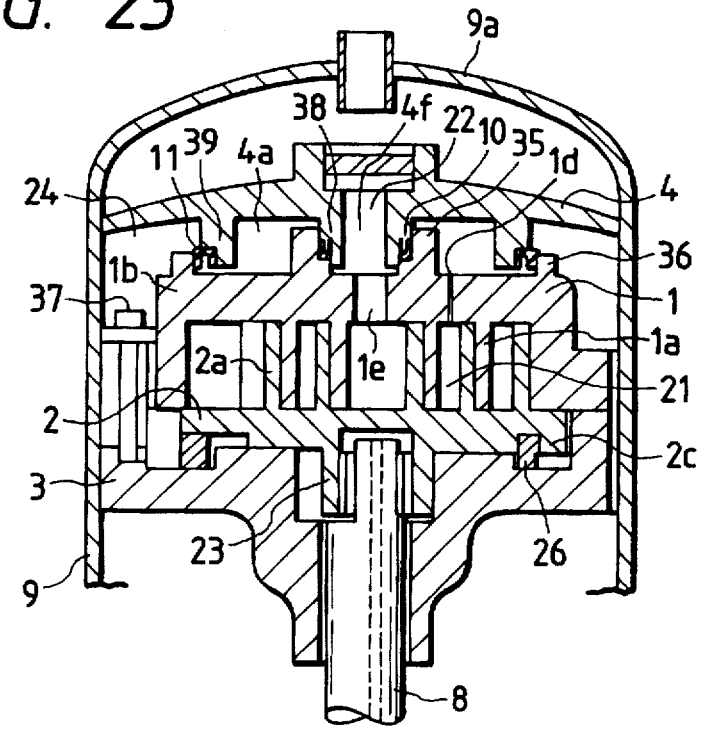
FIG. 23 is a longitudinal sectional view of another conventional scroll compressor.
Figure 24:
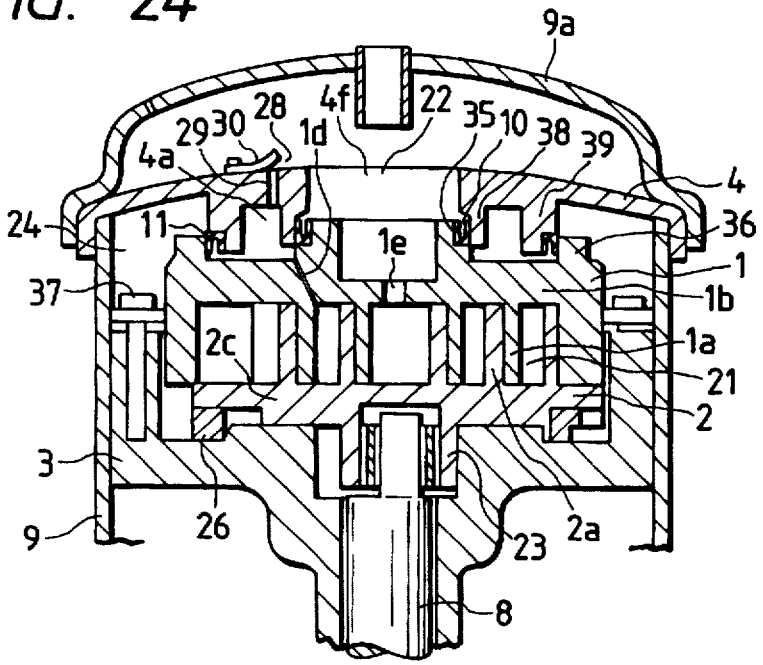
FIG. 24 is a longitudinal sectional view of another conventional scroll compressor.

The scroll compressor having the structure also operates like the scroll compressor in FIG. 23 and compresses a refrigerant gas. The discharge port 4*f* which is placed concentrically with the discharge port 1*e* of the fixed scroll 1 and has a bore larger than the bore of the discharge port 1*e* of the fixed scroll 1 is disposed at the center of the high and low pressure separator 4.

Thus, when the refrigerant gas is discharged, flow passage resistance lessens, decreasing a pressure loss. Therefore, a problem in which a pressure loss, etc., increases due to a complicated flow passage form, lowering the compression efficiency, can be solved, improving the compression efficiency.

A scroll compressor is available which is provided with the high and low pressure separator 4 for simply preventing heat from being leaked from the high pressure chamber 22 to the compression space 21. In such a structure, the scroll compressor structure in FIG. 18 can also be applied for lessening the flow passage resistance when the refrigerant gas is discharged, thereby improving the compression efficiency.

Embodiment 15

Figure 19:
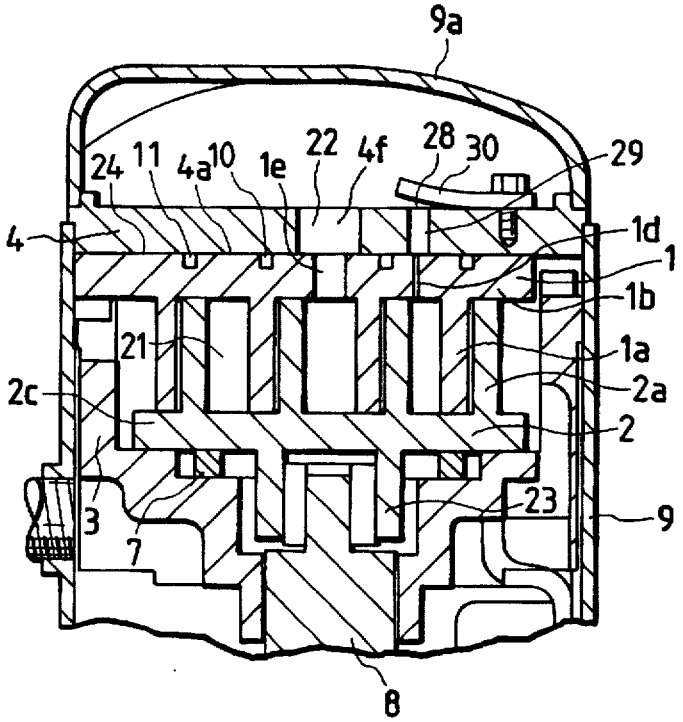
FIG. 19 is a longitudinal sectional view of a scroll compressor according to a fifteenth embodiment of the invention.
Figure 20:
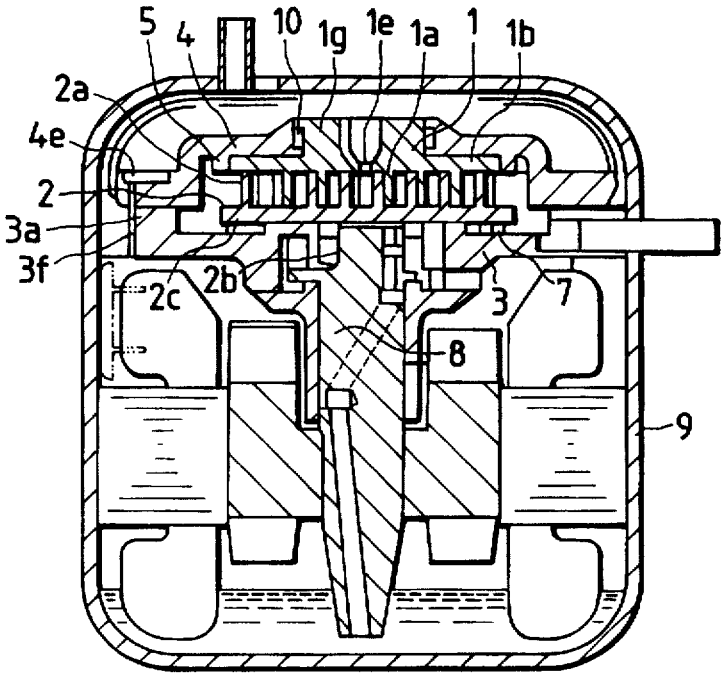
FIG. 20 is a longitudinal sectional view of a conventional scroll compressor.
Figure 22:
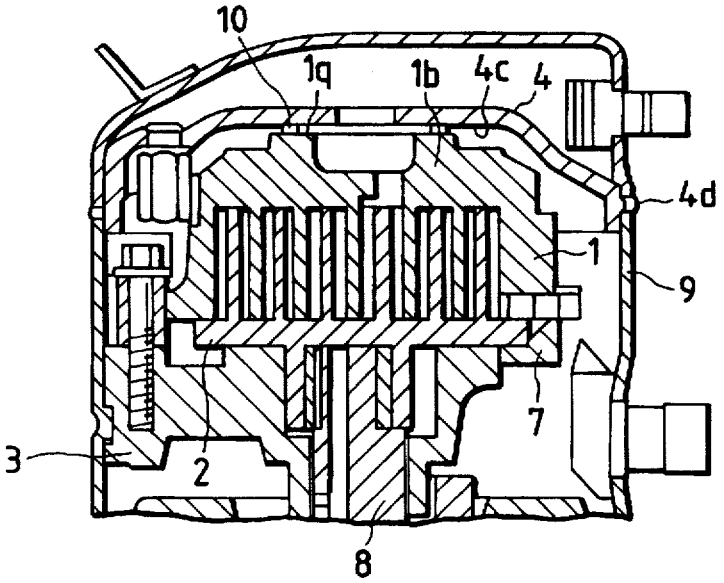
FIG. 22 is a longitudinal sectional view of another conventional scroll compressor.
Figure 21:
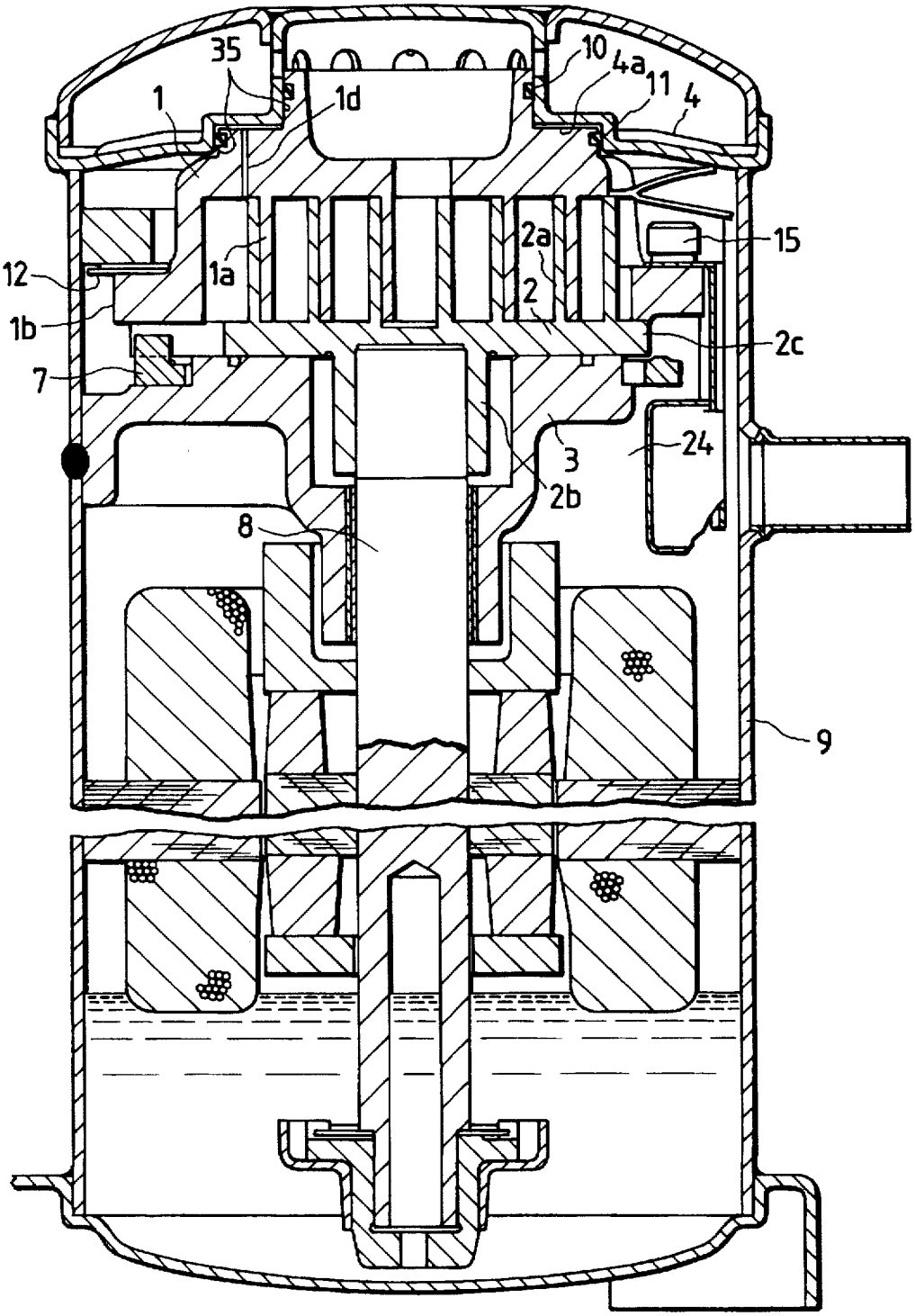
FIG. 21 is a longitudinal sectional view of another conventional scroll compressor.

FIG. 19 is a longitudinal sectional view of the main part showing another embodiment of the invention. Parts identical with or similar to those previously described with reference to FIG. 18 are denoted by the same reference numerals in FIG. 19. In FIG. 19, numeral 28 is a pressure release device made up of a relief port 29 disposed in a high and low pressure separator 4 and an opening/closing valve 30 placed facing the relief port 29.

The scroll compressor having the structure also operates like the scroll compressor in FIG. 23 and compresses a refrigerant gas. The relief port 29 disposed in the high and low pressure separator 4 has a center located in a position substantially matching the center of an extraction hole 1*d* of a fixed scroll 1. Thus, the pressure transmission path from the extraction hole id to the pressure release device 28 shortens and the relief port 29 and the extraction hole 30 match in the pressure transmission direction on the pressure transmission path.

Therefore, if pressure in a back pressure chamber 4*a* abnormally rises, the pressure release device 28 releases the pressure in the back pressure chamber 4*a* without delay at the same time as the pressure abnormally rises. Thus, the pressure in the back pressure chamber 4*a* producing a force pressing the fixed scroll 1 against an orbiting scroll 2 does not abnormally rise at any time, thereby preventing the press force acting on the orbiting scroll 2 from becoming excessive, promoting tooth tip wear of a fixed scroll plate-like spiral tooth 1*a* and an orbiting scroll plate-like spiral tooth 2*a*, and damaging them; failure occurrence can be decreased, improving operation reliability.

The invention produces the following effects:

An outer peripheral portion of the base plate of the fixed scroll is radially supported by a circular cylinder of the stationary member, which circular cylinder is coaxial with the outer peripheral portion of the base plate of the fixed scroll, and the outer peripheral portion of the fixed scroll is axially slidable along the circular cylinder of the stationary member as a guide within a range in which one axial end thereof interferes with the orbiting scroll and the other axial end thereof interferences with the stationary member. Thus, the place where the fixed scroll is radially supported (the outer peripheral portion of the fixed scroll) is near the radial load acting position of the fixed scroll, so that a high-efficiency and high-reliability scroll compressor with little moment making the fixed scroll unstable can be provided. Since the axial downward position regulation member of the fixed scroll is an orbiting scroll, tooth tip leakage gap is substantially zero; a high-efficiency scroll compressor can be provided.

Rotation of the fixed scroll with respect to the stationary member is regulated by rotation direction regulation means, and the outer peripheral portion of the base plate of the fixed scroll and the rotation direction regulation means are disposed to almost match in axial position. Thus, the axial position supporting a radial load of the fixed scroll matches the axial position restraining rotation (on which couple acts); a high-reliability scroll compressor free from a moment causing unstable behavior of the fixed scroll can be provided.

Rotation of the fixed scroll with respect to the stationary member is regulated by rotation direction regulation means, and a clearance between the fixed scroll and the rotation direction regulation means is made larger than a clearance between the outer peripheral portion of the base plate of the fixed scroll and a sliding portion of the circular cylinder of the stationary member. Thus, the radial load acting on the fixed scroll basically is supported on the outer periphery of the base plate; an excessive load does not act on the rotation regulation means and operability is also good. Therefore, a high-efficiency and high-reliability scroll compressor can be provided.

The seal member is disposed in the clearance between the stationary member and the fixed scroll at a set portion which is formed on a plane parallel with the base plate of the fixed scroll. Thus, in assembling, the fixed scroll is not diametrically restrained at the seal position; a low-cost scroll compressor excellent in an assembly property can be provided. In addition, clearance imbalance of seal place caused by assembly failure does not occur either; a high-efficiency and high-reliability scroll compressor good in a seal property can be provided.

Since a seal member disposed in a clearance between the stationary member and the fixed scroll is in the form of a ring having a joint, the joint can absorb dimensional variation. Thus, the sealing property can be assured, and a high-efficiency and high-reliable scroll compressor can be provided.

An elastic member which, when set into a ring-like configuration, defines a slope surface decreasing in height from an inner peripheral side thereof to an outer peripheral side thereof and produces a force to enlarge the ring-like configuration, wherein the seal member is mounted onto the slope surface. Thus, at a stop condition of the scroll compressor, the elastic member attempts to enlarge radially outwardly due to its elasticity, so that the seal member is raised upwardly by the slope surface and depressed outwardly thereby, whereby it is lightly depressed against a wall surface of a groove accommodating seal member. If the compressor starts under this condition, intermediate pressure and high pressure are both sealed immediately after the start, so that the high pressure are sent behind the seal member, and the seal member is surely brought into pressure contact with the stationary member and the inner wall of the seal member accommodation groove. Accordingly, the sealing property can be assured, and a high-efficient and high-reliable scroll compressor can be provided.

An area onto which discharge pressure behind the fixed scroll is applied is substantially as large as a discharge port area. The force which depresses the fixed scroll against the orbiting scroll at the vacuum operation condition can be made relatively small. Thus, high-reliable scroll compressor free from damage of tooth tips can be provided.

Extraction holes for communicating an intermediate pressure chamber behind the fixed scroll with a compression space defined by the plate-like spiral teeth are provided for paired two pressure chambers, respectively. Thus, an abnormal rotation moment does not occur in the fixed scroll or the orbiting scroll, providing a high-reliability scroll compressor wherein rotation restraint means such as the Oldham's coupling and rotation regulation means are not damaged due to an excessive load.

A second interference member other than the orbiting scroll for regulating an axial (downward) travel distance of the fixed scroll on the plate-like spiral tooth side of the fixed scroll is provided. Thus, even if the tooth tips of the plate-like spiral teeth wear, the fixed scroll interferes with the second interference member when the distance between the base plate of the fixed scroll and the base plate of the orbiting scroll becomes slightly short, whereby the pressing force to the tooth tips of the plate-like spiral teeth decreases, and wear development of the tooth tips is stopped. Therefore, a stable-performance scroll compressor wherein the stroke volume of the compressor does not decrease with use can be provided; in addition, a high-reliability scroll compressor as the entire air conditioner with few amount of sludge occurrence can be provided.

An outer peripheral portion of the base plate of the fixed scroll is supported by a circular cylinder of a stationary member, and the second interference member is made up of an upper end face of an outer peripheral wall of the frame, which interferes with a part of the outer peripheral portion of the base plate of the fixed scroll. Thus, even though the fixed scroll is axially moved along the circular cylinder of the stationary member as a guide so that the tip of plate-like tooth experiences wearing, the outer periphery of the base plate of the fixed scroll interferes with the upper end face of the outer peripheral wall of the frame when the distance between the base plate of the fixed scroll and the base plate of the orbiting scroll becomes slightly short, whereby the pressing force to the tooth tips of the plate-like spiral teeth decreases, and wear development of the tooth tips is stopped. Therefore, a stable-performance scroll compressor wherein the stroke volume of the compressor does not decrease with use can be provided; in addition, a high-reliability scroll compressor as the entire air conditioner with few amount of sludge occurrence can be provided.

The fixed scroll is coupled to the frame through a plate spring, the second interference member is made up of an upper end face of an outer peripheral wall of the frame, which interferes with a part of the outer peripheral portion of the base plate of the fixed scroll through the plate spring. Thus, even though the fixed scroll is axially moved so that the tip of plate-like tooth experiences wearing, the outer periphery of the base plate of the fixed scroll interferes with the upper end face of the outer peripheral wall of the frame when the distance between the base plate of the fixed scroll and the base plate of the orbiting scroll becomes slightly short, whereby the pressing force to the tooth tips of the plate-like spiral teeth decreases, and wear development of the tooth tips is stopped. Therefore, a stable-performance and high-reliability scroll compressor can be provided.

In a scroll compressor having a frame coupled to a fixed scroll through a plate spring, the plate spring and the fixed scroll or the plate spring and the frame are fastened by means of a reamer bolt, or the plate spring and the fixed scroll or the plate spring and the frame are fastened by means of a reamer pin and a bolt. Thus, even if an excessive load acts on the fixed scroll at the liquid compression operation, etc., the fixed scroll and the frame are not detached and phase shift and diametric gap that cannot be followed do not occur, providing a high-efficiency and high-reliability scroll compressor.

Since the plate spring and the fixed scroll or the plate spring and the frame are fastened by at least two reamer bolts or two reamer pins, even if an excessive load acts on the fixed scroll at the liquid compression operation, etc., the fixed scroll and the frame are not detached, providing a high-efficiency and high-reliability scroll compressor.

In a scroll compressor wherein a fixed scroll and a plate spring are coupled together through a plate spring, and the fixed scroll capable of making minute axial motion with axial direction compliance means, the plate spring is fixed to a face of a spiral side of the base plate of the fixed scroll. The scroll compressor becomes free from need to elongate the base plate downwardly which has been required in case where it is fixed to a opposite face from the spiral side. Thus, the volume of the fixed scroll can be lessened and the axial minute follow-up operability of the fixed scroll becomes good, providing a high-performance and high-reliability scroll compressor which well follows a form error of the parts and does not delay in relief at the relief time.

In a scroll compressor wherein a fixed scroll and a frame are coupled together through a plate spring, and the fixed scroll is capable of making minute axial motion with axial direction compliance means, one of the plate springs is fastened to a face, oriented in a spiral direction, of an outer periphery of the base plate of the fixed scroll by a bolt, whereas the other is fastened to an upper end face of a frame outer peripheral wall surrounding the fixed scroll spiral substantially over its overall height by a bolt, and, further, relief parts are provided at corresponding points of the base plate of the fixed scroll and an upper end face of the frame outer peripheral wall for avoiding interference of heads of the fastening bolts. Thus, the interference with the heads of the fastening bolts can be prevented by the relief parts, and the fixed scroll can be made small in volume. The axial minute follow-up operability of the fixed scroll becomes good.

Since the relief parts include a notch, spot facing, or equivalent provided on an outer peripheral portion of the fixed scroll and a notch, spot facing, or equivalent recess provided on the upper end face of the frame outer peripheral wall, they are formed easily and the fixed scroll can be made small.

In a scroll compressor wherein a fixed scroll and a frame are coupled together through a plate spring, and the fixed scroll is capable of making minute axial motion with axial direction compliance means, relative positioning of the fixed scroll and the frame when to be assembled together is ensured by inserting reamer pins into reamer holes formed respectively in the fixed scroll and the frame. Accordingly, the fixed scroll and the frame (thus, the orbiting scroll) can be assemble together with the phase therebetween be determined with high accuracy, and thus a high-efficiency scroll compressor with a small leakage gap in radial direction of a compression space can be provided.

In a scroll compressor wherein a space between the fixed scroll and the stationary member is divided by a seal member, and compressed gas from a compression space applies pressure onto a pressure seal face of the fixed scroll to energize the fixed scroll toward the orbiting scroll, the stationary member is welded to the sealed vessel near an axial position of the pressure seal face, whereby the bend moment produced by the shrinkage force by welding that acts on the seal plane can be reduced and seal plane deformation can be decreased for providing a scroll compressor which is highly reliable in the seal part.

In a scroll compressor provided with a high and low pressure separator fixed to a sealed vessel and a plate spring through which a fixed scroll and an orbiting scroll are coupled together, an axial (upward) travel distance of a side of the fixed scroll opposite from a plate-like spiral tooth side is regulated by interference with the high and low pressure separator or a member attached to the high and low pressure separator. Thus, a strong upward collision of the fixed scroll occurring at the liquid compression time, etc., is received at the high and low pressure separator, providing a high-reliability scroll compressor wherein damage to the parts or parts fastening failure is not caused by a collision.

In case a high and low pressure separator regulating an axial (upward) travel distance of a side of the fixed scroll opposite from a plate-like spiral tooth side is to be fixed to the sealed vessel, the high and low pressure separator is axially positioned by pressing it against the frame or a member attached to the frame. Thus, the distance between the high and low pressure separator and the fixed scroll can be easily managed with high accuracy, providing a high-reliability scroll compressor wherein the parallelism of the high and low pressure separator and the fixed scroll can be well managed and a single hit when the fixed scroll collides with the high and low pressure separator is prevented. Further, since the travel distance of the fixed scroll is managed accurately, a high-reliability scroll compressor can be provided wherein trouble such that the maximum relief amount is too excessive to provide a compression function at starting does not occur.

In a scroll compressor provided with a stationary member disposed at an opposite side of a fixed scroll with respect to an orbiting scroll, and a plate spring through which the fixed scroll and a frame are coupled together, the rear of the fixed scroll is brought into close contact with the stationary member by an initial pressing force of the plate spring at operation stop state and no intermediate chamber is provided. Thus, the fixed scroll is not strongly pressed against the orbiting scroll just after the compressor is started normally or with full liquid; a low-noise and high-reliability scroll compressor which starts slowly is provided.

A plate spring connecting a fixed scroll to a frame includes a number of sheet members laminated axially one on another. Thus, a large compression capacity scroll compressor which can maintain a good axial relief characteristic even if the plate spring strength is increased can be provided.

In a scroll compressor having a plate spring connecting a fixed scroll to a frame, the plate spring is sandwiched between an inner peripheral side step part on a plate spring attachment face of the base plate of the fixed scroll and an inner wall face of a sealed shell to regulate diametric displacement. Since the plate spring is sandwiched between the inner peripheral side step part on the plate spring attachment face of the base plate of the fixed scroll and the inner wall face of the sealed shell to regulate diametric displacement, the plate spring does not shift even in an operation condition in which an excessive load acts on the spiral at the liquid compression time, etc., and thus a scroll compressor which does not lower in performance or noise characteristic can be provided.

A stationary member for regulating axial movement of the fixed scroll toward a side opposite from the plate-like spiral tooth of the fixed scroll is provided, and axial dimensions of spiral teeth of the fixed scroll and the orbiting scroll are set so that a tip of the spiral tooth of the fixed scroll comes in contact with a bottom of the spiral tooth of the orbiting scroll while a tip of the spiral tooth of the orbiting scroll and a bottom of the spiral tooth of the fixed scroll have a minute axial gap during operation. Thus, even if material whose wear easily develops is used for the orbiting scroll, the spiral tooth tips can be prevented from wearing and the orbiting scroll weight can be reduced.

In a scroll compressor in which a fixed scroll is coupled to a frame through a plate spring, and which is provided with a stationary member for regulating axial movement of the fixed scroll toward a side opposite from the plate-like spiral tooth of the fixed scroll, the scroll compressor is further provided with means for axially and diametrically positioning the stationary member and the frame. Thus, a high-reliability scroll compressor wherein accurate positioning can be performed and an assembly error can be prevented can be provided.

The axial and diametric positioning means for the stationary member and the frame comprise a plurality of reamer holes formed in a high and low pressure separator, reamer holes formed in the frame at positions corresponding to the reamer holes of the high and low pressure separator, and stepped pins inserted in respective reamer holes. Thus, axial and diametric positioning of the high and low pressure separator and the frame can be performed at the same time for improving assembly.

A discharge port of a stationary member disposed at an opposite side of the fixed scroll with respect to the orbiting scroll is arranged coaxial with respect to a discharge port of a fixed scroll and lager in diameter than the discharge portion of the fixed scroll. Thus, the discharge flow passage of a refrigerant gas defined by the discharge ports of the fixed scroll and the stationary member is simplified, so that the flow passage resistance when a refrigerant gas is discharged lessens, decreasing the pressure loss. Thus, a problem of lowering the compression efficiency due to a pressure loss when a refrigerant gas is discharged is solved, improving compression efficiency.

In a scroll compressor having axial direction compliance means, since a fixed scroll is capable of making minute axial motion with the axial direction compliance means, and a discharge port of a stationary member disposed at an opposite side of the fixed scroll with respect to the orbiting scroll is arranged coaxial with respect to a discharge port of the fixed scroll and lager in diameter than the discharge portion of the fixed scroll, the discharge flow passage of a refrigerant gas defined by the discharge ports of the fixed scroll and the stationary member is simplified, so that the flow passage resistance when a refrigerant gas is discharged lessens, decreasing the pressure loss.

A stationary member is disposed at an opposite side of the fixed scroll with respect to the orbiting scroll for prohibiting displacement of the fixed scroll away from the orbiting scroll beyond a predetermined position, and the stationary member is provided with a pressure release device made up of a relief port having a center in alignment with a center of an extraction hole arranged in the fixed scroll and a valve for opening and closing the relief port. The pressure transmission path from the extraction hole to the pressure release device shortens and the relief port and the extraction hole match in the pressure transmission direction on the pressure transmission path. Thus, if the pressure in the back pressure chamber between the high and low pressure separator and the fixed scroll abnormally rises, the pressure release device operates without delay. This effect can prevent the press force acting on the orbiting scroll from becoming excessive when the pressure in the back pressure chamber abnormally rises, promoting tooth tip wear of the fixed spiral tooth and the orbiting spiral tooth, and damaging them; operation reliability is improved.

What is claimed is:

1. A scroll compressor comprising in a sealed vessel:

a fixed scroll having a fixed scroll base plate, one side of said fixed scroll being formed with a plate-like spiral tooth;

an orbiting scroll having an orbiting scroll base plate and a boss portion, one side of said orbiting scroll being formed with a plate-like spiral tooth of substantially the same form as the plate-like spiral tooth of the fixed scroll, wherein a drive member for receiving a driving force is positioned on an opposite side of the orbiting scroll base plate and is drivingly connected to said boss portion, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through a plate spring which permits the fixed scroll to make minute axial displacements, said plate spring being inserted between an upper end face of the frame and a lower end face of the fixed scroll, wherein:

the plate spring and the fixed scroll or the plate spring and the frame are fastened to each other by means of a reamer bolt or a reamer pin, or the plate spring and the fixed scroll or the plate spring and the frame are fastened to each other by means of a reamer pin and a bolt.

2. A scroll compressor as claimed in claim 1, wherein the plate spring and the fixed scroll or the plate spring and the frame are fastened by at least two reamer bolts or two reamer pins.

3. A scroll compressor comprising in a sealed vessel:

a fixed scroll having a fixed scroll base plate, one side of said fixed scroll being formed with a plate-like spiral tooth;

an orbiting scroll having an orbiting scroll base plate and a boss portion, one side of said orbiting scroll being formed with a plate-like spiral tooth of substantially the same form as the plate-like spiral tooth of the fixed scroll, wherein a drive member for receiving a driving force is positioned on an opposite side of the orbiting scroll base plate and is drivingly connected to said boss portion, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through a plate spring which permits the fixed scroll to make minute axial motions, wherein:

the plate spring is fixed to a face of a spiral side of the fixed scroll base plate of the fixed scroll.

4. A scroll compressor comprising in a sealed vessel:

a fixed scroll having a fixed scroll base plate, one side of said fixed scroll being formed with a plate-like spiral tooth;

an orbiting scroll having an orbiting scroll base plate and a boss portion, one side of said orbiting scroll being formed with a plate-like spiral tooth of substantially the same form as the plate-like spiral tooth of the fixed scroll wherein a drive member for receiving a driving force is positioned on an opposite side of the orbiting scroll base plate and is drivingly connected to said boss portion, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through plate springs, wherein:

one of the plate springs is fastened to a face, oriented in a spiral direction with respect to an axis of said fixed scroll, of an outer periphery of the fixed scroll base plate of the fixed scroll by a bolt;

the other of said plate springs being fastened to an upper end face of a frame outer peripheral wall surrounding the fixed scroll substantially over its overall height by a bolt; and relief parts are provided at corresponding points of the base plate of the fixed scroll and an upper end face of the frame outer peripheral wall for avoiding interference of heads of the fastening bolts.

5. A scroll compressor as claimed in claim 4, wherein the relief parts include a notch, or equivalent provided on an outer peripheral portion of the fixed scroll and a notch, or equivalent recess provided on the upper end face of the frame outer peripheral wall.

6. A scroll compressor comprising in a sealed vessel:

a fixed scroll having a fixed scroll base plate, one side of said fixed scroll being formed with a plate-like spiral tooth;

an orbiting scroll having an orbiting scroll base plate and a boss portion, one side of said orbiting scroll being formed with a plate-like spiral tooth of substantially the same form as the plate-like spiral tooth of the fixed scroll, wherein a drive member for receiving a driving force is positioned on an opposite side of the orbiting scroll base plate and is drivingly connected to said boss portion, the orbiting scroll executing orbiting motion with respect to the fixed scroll;

a frame fixedly supported to the sealed vessel for axially supporting the orbiting scroll and radially supporting a drive shaft, the frame being coupled to the fixed scroll through a plate spring; and a high and low pressure separator located at an opposite side of the fixed scroll with respect to the orbiting scroll and fixed to the sealed vessel, wherein:

an axial travel distance of a side of the fixed scroll opposite from a plate-like spiral tooth side is regulated by interference with the high and low pressure separator or a member attached to the high and low pressure separator.

7. A scroll compressor as claimed in claim 6, wherein the high and low pressure separator is axially positioned by pressing it against the frame or a member attached to the frame.

8. A scroll compressor comprising in a sealed vessel:

a fixed scroll having a fixed scroll base plate, one side of the fixed scroll being formed with a plate-like spiral tooth;

an orbiting scroll having an orbiting scroll base plate and a boss portion, one side of said orbiting scroll being formed with a plate-like spiral tooth of substantially the same form as the plate-like spiral tooth of the fixed scroll, wherein a drive member for receiving a driving force is positioned on an opposite side of the orbiting scroll base plate and is drivingly connected to said boss portion, the orbiting scroll executing orbiting motion with respect to the fixed scroll;

a frame fixedly supported to the sealed vessel for axially supporting the orbiting scroll and radially supporting a drive shaft, the frame being coupled to the fixed scroll through a plate spring; and a stationary member located at an opposite side of the fixed scroll with respect to the orbiting scroll, wherein:

a rear of the fixed scroll is brought into close contact with the stationary member by an initial pressing force of the plate spring under an operation stop state to provide no intermediate chamber.

9. A scroll compressor comprising in a sealed vessel:

a fixed scroll having a first scroll base plate, one side of said fixed scroll being formed with a plate-like spiral tooth;

an orbiting scroll having an orbiting scroll base plate and a boss portion, one side of said orbiting scroll being formed with a plate-like spiral tooth of substantially the same form as the plate-like spiral tooth of the fixed scroll, wherein a drive member for receiving a driving force is positioned on an opposite side of the orbiting scroll base plate and is drivingly connected to said boss portion, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through a plate spring, wherein:

the plate spring includes a number of sheet members laminated axially one on another.

10. A scroll compressor comprising in a sealed vessel:

a fixed scroll having a fixed scroll base plate, one side of said fixed scroll being formed with a plate-like spiral tooth;

an orbiting scroll having an orbiting scroll base plate and a boss portion, one side of the orbiting scroll being formed with a plate-like spiral tooth of substantially the same form as the plate-like spiral tooth of the fixed scroll, wherein a drive member for receiving a driving force is positioned on an opposite side of the orbiting scroll base plate and is drivingly connected to said boss portion, the orbiting scroll executing orbiting motion with respect to the fixed scroll; and a frame fixedly supported to the sealed vessel for axially supporting the orbiting scroll and radially supporting a drive shaft, the frame being coupled to the fixed scroll through a plate spring, wherein:

the plate spring is sandwiched between an inner peripheral side step part on a plate spring attachment face of the fixed scroll base plate of the fixed scroll and an inner wall face of a sealed shell to regulate diametric displacement.

11. A scroll compressor comprising in a sealed vessel:

a fixed scroll having a fixed scroll base plate, one side of said fixed scroll being formed with a plate-like spiral tooth;

an orbiting scroll having an orbiting scroll base plate and a boss portion, one side of the orbiting scroll being formed with a plate-like spiral tooth of substantially the same form as the plate-like spiral tooth of the fixed scroll, wherein a drive member for receiving a driving force is positioned on an opposite side of the orbiting scroll base plate and is drivingly connected to said boss portion, the orbiting scroll executing orbiting motion with respect to the fixed scroll;

a frame fixedly supported to the sealed vessel for axially supporting the orbiting scroll and radially supporting a drive shaft; and a stationary member located at an opposite side of the fixed scroll with respect to the orbiting scroll for regulating axial movement of the fixed scroll toward a side opposite from the plate-like spiral tooth of the fixed scroll, wherein:

axial dimensions of spiral teeth of the fixed scroll and the orbiting scroll are set so that a tip of the spiral tooth of the fixed scroll comes in contact with a bottom of the spiral tooth of the orbiting scroll while a tip of the spiral tooth of the orbiting scroll and a bottom of the spiral tooth of the fixed scroll have a minute axial gap during operation.

12. A scroll compressor comprising in a sealed vessel:

a fixed scroll having a fixed scroll base plate, one side of said fixed scroll being formed with a plate-like spiral tooth;

an orbiting scroll having an orbiting scroll base plate and a boss portion, one side of said orbiting scroll being formed with a plate-like spiral tooth of substantially the same form as the plate-like spiral tooth of the fixed scroll, wherein a drive member for receiving a driving force is positioned on an opposite side of the orbiting scroll base plate and is drivingly connected to said boss portion, the orbiting scroll executing orbiting motion with respect to the fixed scroll;

a frame fixedly supported to the sealed vessel for axially supporting the orbiting scroll and radially supporting a drive shaft, the frame being coupled to the fixed scroll through a plate spring;

a stationary member for regulating axial movement of the fixed scroll toward a side opposite from the plate-like spiral tooth of the fixed scroll; and means for axially and diametrically positioning the stationary member and the frame;

wherein the axial and diametric positioning means for the stationary member and the frame comprise a plurality of reamer holes formed in a high and low pressure separator, reamer holes formed in the frame at positions corresponding to the reamer holes of the high and low pressure separator, and stepped pins inserted in respective reamer holes.

* * * * *